US007005808B2

(12) United States Patent
Ohta et al.

(10) Patent No.: US 7,005,808 B2
(45) Date of Patent: Feb. 28, 2006

(54) DISCHARGE LAMP ILLUMINATION CIRCUIT

(75) Inventors: Shinji Ohta, Shizuoka (JP); Masayasu Ito, Shizuoka (JP)

(73) Assignee: Koito Manufacturing Co. Ltd., Tokyo (JP)

( * ) Notice: Subject to any disclaimer, the term of this patent is extended or adjusted under 35 U.S.C. 154(b) by 0 days.

(21) Appl. No.: 10/914,664

(22) Filed: Aug. 9, 2004

(65) Prior Publication Data

US 2005/0035725 A1 Feb. 17, 2005

(30) Foreign Application Priority Data

Aug. 13, 2003 (JP) ..... P.2003-292712

(51) Int. Cl.
*H05B 37/02* (2006.01)
*G05F 1/00* (2006.01)

(52) U.S. Cl. ..... 315/226; 315/DIG. 7; 315/291

(58) Field of Classification Search ..... 315/307, 315/291, 209 R, 224–226, DIG. 2, DIG. 5, 315/DIG. 7
See application file for complete search history.

(56) References Cited

U.S. PATENT DOCUMENTS 5,449,973 A * 9/1995 Yamashita et al. ..... 315/82
5,563,777 A * 10/1996 Miki et al. ..... 363/37
5,666,279 A * 9/1997 Takehara et al. ..... 363/95
6,034,490 A * 3/2000 Yamashita et al. ..... 315/310
6,057,652 A * 5/2000 Chen et al. ..... 315/307
6,340,870 B1 * 1/2002 Yamashita et al. ..... 315/308
6,437,515 B1 * 8/2002 Kamoi et al. ..... 315/209 R
6,489,732 B1 * 12/2002 Ito et al. ..... 315/308
6,943,502 B1 * 9/2005 Yamanaka et al. ..... 315/224
2005/0057181 A1 * 3/2005 Izumi et al. ..... 315/209 R

FOREIGN PATENT DOCUMENTS

JP 7-142182 6/1995
JP 7-169583 7/1995

* cited by examiner

*Primary Examiner*—Wilson Lee
*Assistant Examiner*—Hung Tran Vy
(74) *Attorney, Agent, or Firm*—Fish & Richardson P.C.

(57) ABSTRACT

A discharge lamp illumination circuit 1 has a DC-AC conversion circuit 3, which effects DC-AC conversion and boosting upon receipt of a DC input, and a starter circuit 4. Power output from the DC-AC conversion circuit 3 is controlled by means of control means 6. The DC-AC conversion circuit 3 has an AC conversion transformer 7; a plurality of switching elements 5H and 5L; and a resonance capacitor 8. The switching elements are activated by the control means 6, thereby causing serial resonance between the resonance capacitor 8 and a leakage inductance component of the AC conversion transformer 7, or between the resonance capacitor 8 and an inductance component 9 connected to the resonance capacitor 8. Provided that a resonance frequency achieved during an extinction period of the discharge lamp 10 is denoted as f1, the operating frequency is first regulated to a frequency level deviating from f1 and then gradually reduced so as to approach f1 in connection with a no-load voltage which is applied to the discharge lamp before illuminating.

7 Claims, 13 Drawing Sheets

DISCHARGE LAMP ILLUMINATION CIRCUIT

This application claims foreign priority based on Japanese Patent application No. 2003-292712, filed Aug. 13, 2003, the contents of which is incorporated herein by reference in its entirety.

TECHNICAL FIELD

The present disclosure relates to a discharge lamp illumination circuit which has a DC-AC conversion circuit and is adaptable to increasing frequency, and more particularly to a technique for suppressing a circuit loss and causing a discharge lamp to safely transit to a steady illumination state.

BACKGROUND

One configuration of an illumination circuit of a discharge lamp (e.g., a metal halide lamp) includes a DC power supply circuit having a a DC-DC converter; a DC-AC conversion circuit (i.e., an inverter circuit); and a starter circuit (i.e., a starter). According to one application of such a configuration, a DC voltage from a battery is converted to a desired voltage in the DC power supply circuit, and is further converted to an AC output voltage in the subsequent DC-AC conversion circuit. A start-up signal (a so-called starter pulse) is superposed thereon, and the superposed voltage is supplied to the discharge lamp (see, for example, Japanese patent document JP-A-7-142182).

However, a configuration where a voltage is converted through two stages (i. e., a DC-DC voltage conversion and a DC-AC conversion) is not suitable for reducing the size of a large circuit. Therefore, Other configurations have been suggested. For example, in one alternative configuration, an output whose voltage has been boosted by a single-stage voltage conversion in a DC-AC conversion circuit is supplied to a discharge lamp (see, e.g., Japanese patent document JP-A-7-169583).

Subsequently, a no-load voltage (hereinafter, referred to as "OCV") before the discharge lamp is illuminated (i.e., during an extinction period) is controlled in such a manner that a start-up signal is generated and supplied to the discharge lamp, thereby causing the discharge lamp to illuminate.

Thereafter, operational control (i.e., switching control) of the DC-AC conversion circuit is conducted to cause a transition to a steady illumination state.

Conventional illumination circuits may have various problems. For example, a loss during an extinction period (i. e., under no load) of the discharge lamp may cause a decline in circuit efficiency. Smooth and reliable transition of the discharge lamp to a stable illumination state may be difficult or may require a complicated control configuration.

SUMMARY

The present disclosure relates to a discharge lamp illumination circuit including a DC-AC conversion circuit, which effects DC-AC conversion and a boost upon receipt of a DC input, and a starter circuit for supplying a start-up signal to a discharge lamp. Further, the discharge lamp illumination circuit conducts illumination control of the discharge lamp by controlling a power output from the DC-AC conversion circuit through use of control means. The discharge lamp illumination circuit may be configured as follows.

The DC-AC conversion circuit may have an AC conversion transformer, switching elements, and a resonance capacitor. The switching elements are activated by the control means, thereby causing serial resonance between the resonance capacitor and an inductance component of the AC conversion transformer, or serial resistance between the resonance capacitor and an inductance component connected to the resonance capacitor.

The operating frequency of the switching elements may be controlled so that a resonance voltage generated on a primary side of the AC conversion transformer is boosted to supply electric power to the discharge lamp from a secondary side of the AC conversion transformer.

A resonance frequency during the extinction period of the discharge lamp may be denoted as f1 and a resonance frequency during the illumination period of the discharge lamp may be denoted as f2. Switching of the no-load voltage (OCV) that is applied on the discharge lamp before the discharge lamp is illuminated may be controlled so that the operating frequency is initially regulated at a frequency value differing from f1, and then gradually approaches f1.

According to the invention, therefore, the OCV can be increased by causing the operating frequency to approach the resonance frequency f1 under a no-load state (i.e., during the extinction period) before the discharge lamp is illuminated. Moreover, complicated control is not required.

In various implementations, one or more of the following advantages may be present. For example, the disclosed techniques may provide reliable transition-to-steady-illumination control of a discharge lamp by controlling the operating frequency of switching elements. The invention also may result in miniaturization and cost reduction of the discharge lamp.

Where the operating frequency is controlled so that the operating frequency is decreased from a frequency higher than f1 so as to approach f1, for example, the operating frequency does not remain for a long time in an AM band or the like, and external influence by radio noise or the like can be avoided. Similarly, when the operating frequency of the switching elements is regulated at a frequency value higher than the frequency f2 immediately after power is applied to the illumination circuit or immediately after the discharge lamp is extinguished after having once been illuminated, the same transition-to-steady-illumination control can be set for the following two cases: (i) the discharge lamp is caused to illuminate immediately after the power supply to the illumination circuit is turned on; and (ii) the discharge lamp is caused to be re-illuminated because the discharge lamp is extinguished after once having been illuminated. Accordingly, the circuit configuration can be simplified.

Further, where the operating frequency is controlled such that the frequency is set at an initial value of zero or lower than f1 and caused to increase so as to approach f1, the operating frequency may be increased from a state where the switching elements are inoperative or from a frequency which is sufficiently lower than f1. Therefore, the invention is suitable for miniaturization of the circuit.

When a predetermined period has elapsed from the start of an OCV control during an extinction period of the discharge lamp, the operating frequency preferably is transitioned to a frequency region higher than f2, irrespective of whether or not the discharge lamp is illuminating. In view that a restriction is imposed on a period during which the frequency remains in the vicinity of f1, where power loss is large, the above technique is effective for achieving both improved reliability of illuminating the discharge lamp and reduction of a circuit load. In such a case, when there is adopted a configuration where the operating frequency is regulated at a frequency higher than f2 during the two following periods, a time period including the two periods can be defined in advance: a first period for boosting the OCV to a predetermined voltage; and a subsequent second period during which the operating frequency is fixed. Furthermore, in a configuration in which the operating frequency is fixed during a period for boosting the OCV to a predetermined voltage, and is regulated at a frequency higher than f2 during a subsequent period, the duration of the period during which the operating frequency is fixed can be defined accurately.

Other features and advantages may be apparent from the following detailed description, the accompanying drawings and the claims.

BRIEF DESCRIPTION OF THE DRAWINGS

FIGS. 6 to 14 show example circuit configurations according to the present invention, wherein FIG. 6 is a block diagram showing an example configuration of control means;

FIG. 7 is a circuit diagram showing an example configuration of a current detection circuit of a discharge lamp;

FIG. 8 is a circuit diagram showing an example configuration of a voltage detection circuit of a discharge lamp;

FIG. 9 is a diagram showing an example configuration of illumination/extinction discrimination means;

FIG. 10 is a diagram showing an example configuration of a T1 signal generation circuit;

FIG. 11 is a diagram showing an example configuration of an OCV control circuit;

FIG. 12 is a diagram showing an example configuration of a V-F conversion circuit;

FIG. 13 is a diagram showing an example configuration of an OCV control circuit and a T2 signal generation circuit; and FIG. 14 is a circuit diagram showing only a main portion of an example configuration according to another control mode.

DETAILED DESCRIPTION

Figure 1:
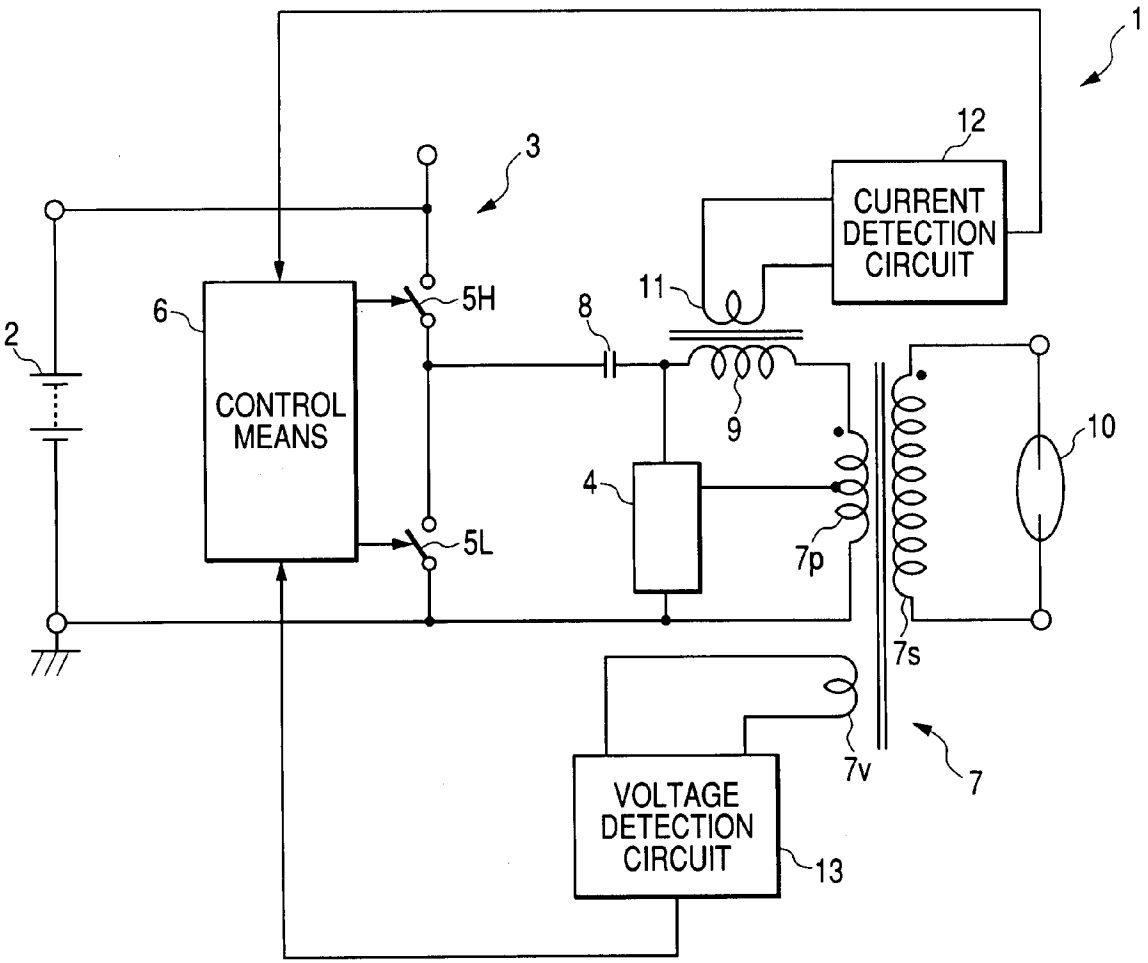
FIG. 1 is a diagram showing an embodiment of the present invention.

FIG. 1 shows an embodiment of the present invention, wherein a discharge lamp illumination circuit 1 includes a DC-AC conversion circuit 3 that receives a power supply from a DC power source 2, and a starter circuit 4.

The DC-AC conversion circuit 3 is provided for effecting DC-AC conversion and boosting upon receipt of a voltage output directly from a battery or the like. The embodiment is provided with two switching elements 5H and 5L, and control means 6 for driving the switching elements 5H and 5L, to effect switching control. One end of the switching element 5H on a higher voltage side is connected to a power supply terminal, and the other end of the switching element 5H on a lower voltage side is grounded via the switching element 5L. Further, the two switching elements 5H and 5L are alternately switched on and off by the control means 6. In FIG. 1, the switching elements 5H and 5L are simply denoted by a switch symbol; however, the switching elements 5H and 5L may comprise a semiconductor switching element such as a field-effect transistor (FET) or a bipolar transistor.

The DC-AC conversion circuit 3 has an AC conversion transformer 7 whose primary circuit and secondary circuit are insulated from each other. The circuit configuration may utilize a resonance phenomenon between a resonance capacitor 8 and an inductor, or between the resonance capacitor 8 and an inductance component. More specifically, the following three circuit configurations can be enumerated:

(I) a configuration which utilizes resonance between the resonance capacitor 8 and an inductance element;

(II) a configuration which utilizes resonance between the resonance capacitor 8 and a leakage inductance of the AC conversion transformer 7; and (III) a configuration which utilizes resonance between the resonance capacitor 8 and a leakage inductance of the inductance element or the AC conversion transformer 7.

The foregoing configuration (I) may be arrange d as follows. An inductance element 9 such as a resonance coil is provided, and one end of the inductance element 9 is, for example, connected to one end of the resonance capacitor 8. The other end of the resonance capacitor 8 is connected to a connecting point between the switching elements 5H and 5L. Further, the other end of the inductance element 9 is connected to a primary winding 7*p* of the AC conversion transformer 7.

The second configuration (II) utilizes the inductance component 9 of the AC conversion transformer 7. Accordingly, a resonance coil or the like does not have to be added. Instead, one end of the resonance capacitor 8 is connected to the connecting point between the switching elements 5H and 5L, and the other end of the resonance capacitor 8 is connected to the primary winding 7*p* of the AC conversion transformer 7.

The third configuration (III) can employ serial synthetic reactance existing between the inductance element 9 and a leakage inductance.

In any of the above configurations, sinusoidal illumination of a discharge lamp 10 (e.g., a metal halide lamp) —which is connected to a secondary winding 7*s* of the AC conversion transformer 7—can be achieved on condition that series resonance between the resonance capacitor 8 and an inductive element (i.e., an inductance component or an inductance element) is utilized; and the switching elements 5H and 5L are alternately switched on and off while the operating frequency of the switching elements is regulated at a series resonant frequency or higher. In operation control of the switching elements by the control means 6, the respective elements 5H and 5L should be activated alternately to prevent a situation where the two switching elements are in on-state (by means of on-duty control, which means control of time ratio of on-duty state, or the like). Here, a series resonant frequency is denoted as "f, " an electrostatic capacity of the resonance capacitor 8 is denoted as "Lr, " and a primary-side inductance of the transformer 7 is denoted as "Lp1." In the above third mode (III), for example, the following relationship holds before the discharge lamp is illuminated:

$$f=f1=1/(2\cdot\pi\cdot\sqrt{Cr(Lr+Lp1)});$$

and the below relationship holds after the discharge lamp is illuminated:

$$f=f2\cong 1/(2\cdot\pi\cdot\sqrt{Cr\cdot Lr}).$$

The starter circuit 4 supplyies a start-up signal to the discharge lamp 10. An output voltage from the starter circuit 4 at the time of start-up is boosted by the AC conversion transformer 7, and the boosted voltage is supplied to the discharge lamp 10 (in other words, the output voltage—which is converted from DC to AC—is superposed on the start-up signal, and then supplied to the discharge lamp). In the illustrated embodiment, one of the output terminals of the starter circuit 4 is connected to a midpoint of the primary winding 7*p* of the AC conversion transformer 7, and the other output terminal is connected is to one end (a grounded terminal) of the primary winding 7*p*. However, the circuit configuration is not limited to that particular implementation. In other implementations, the two output terminals of the starter circuit 4 are connected respectively to midpoints of the primary winding 7*p* of the AC conversion transformer 7. In order to generate a pulse voltage having a peak value sufficiently high for starting the discharge lamp 10 on a secondary side of the AC conversion transformer 7, a capacitor in the starter circuit 4 should be supplied with as high a voltage as possible so as to effect charging. For instance, when one of the input terminals of the starter circuit 4 is connected to a point between the resonance capacitor 8 and the inductance element 9 and the other input terminal is connected to a line of the grounded side, a resultant resonant voltage can be utilized. In addition to the above, an input voltage may be supplied to the starter circuit from the secondary side of the AC conversion transformer 7; or such that an auxiliary winding (a winding 11 described later) which constitutes a transformer in combination with the inductance element 9 may be provided so that an input voltage is supplied to the starter circuit from the auxiliary winding.

During an extinction period before the discharge lamp 10 is illuminated, in the case where the switching elements 5H and 5L are activated to apply the OCV to the discharge lamp in a frequency region lower than the resonance frequency f1, a decline in circuit efficiency resulting from an increased switching loss can become a problem. Also in the case where the switching elements 5H and 5L are activated in a frequency region higher than f1, an increase of the switching loss can become a problem as well. Accordingly, continuous operation of the circuit under no-load is desirably regulated so as not to be prolonged beyond a required period.

During an illumination period of the discharge lamp, the circuit is activated continuously, and this requires high circuit efficiency. At this time, when the switching elements are activated in a frequency region lower than f2, the switching loss is increased to lower the circuit efficiency. Therefore, the switching elements are preferably activated in a frequency region higher than f2.

During an extinction period after the illumination circuit is powered on, the OCV is preferably controlled to a frequency of approximately f1. When the discharge lamp is transitioned to an illumination state after a start-up signal is generated and the discharge lamp is started up, illumination control is preferably exercised in a frequency region higher than f2. However, in the invention, switching control of the OCV may be conducted so that the operating frequency of the switching elements is regulated at a frequency that initially differs from f1, and then gradually approaches f1. More specifically, during the extinction period before the discharge lamp is illuminated, the closer the operating frequency is to the resonant frequency f1, the larger the electric current that is fed to the illumination circuit, because an output voltage of the discharge lamp is increased. In view of this, a method for causing the OCV to approach a target value by changing a value of the operating frequency from a higher-frequency side or a lower-frequency side of a resonance curve—whose peak of an output voltage is at f1—is preferable, in view of safety and reliability of the circuit. Accordingly, the two control modes described below can be adopted:

(i) a control mode A where the operating frequency is decreased from a frequency higher than f1 so as to approach f1; and (ii) a control mode B where the operating frequency is increased from a frequency lower than fi so as to approach f1.

Figure 2:
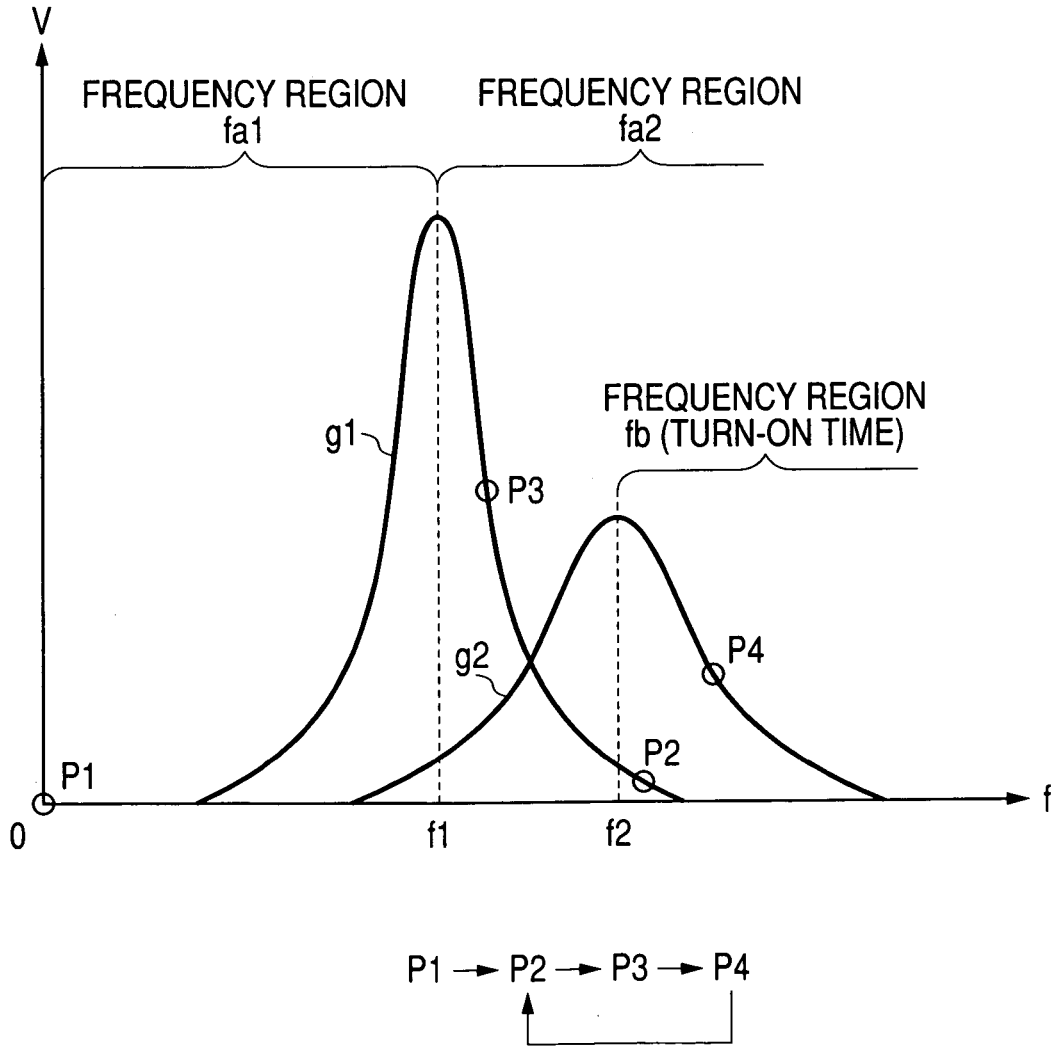
FIG. 2 is a diagram for describing a control mode.

FIG. 2 is a graph for describing the control mode A. FIG. 2 shows a resonance curve g1 of an extinction period of the discharge lamp, and a resonance curve g2 of an illumination period. The horizontal axis indicates a frequency "f," and the vertical axis indicates an output voltage V.

The symbols shown in the figure have the following meanings:

"fa1": a frequency region where "f" is lower than f1;

"fa2": a frequency region where "f" is higher than f1;

"fb": a frequency region where "f" is higher than "f2" (during an illumination period);

"P1": an operating point before the power is on;

"P2": an initial operating point immediately after the power is on (within the frequency region fb);

"P3": an operating point indicating a time when a target value of the OCV is reached during an extinction period; and "P4": an operating point after the discharge lamp is illuminated (within the frequency region fb).

In the control mode A, immediately after the power is turned on or immediately after the discharge lamp is extinguished after temporary illumination, the operating frequency of the discharge lamp is forcibly transitioned to the frequency region fb whose frequency is higher than the resonant frequency f2 of the illumination period (P1→P2). More specifically, the frequency is temporarily increased, and then decreased gradually so as to approach f1 (P2→P3). When the discharge lamp is illuminated, the frequency is again increased to the frequency region fb (P3→P4).

The transition-to-steady-illumination control of the discharge lamp may be conducted in accordance with the following steps: the OCV is controlled; a start-up signal is subsequently generated; and the start-up signal is supplied to illuminate the discharge lamp. In the control of the OCV, as the frequency is decreased from the region fb so as to approach f1 from the higher-frequency side, the output voltage is gradually increased, and attains a target value at the operating point P3 in the frequency region fa. Subsequently, when the discharge lamp is started by the starter circuit 4, the control is transitioned to illumination control (power-on control). The illumination control is performed within the frequency region fb indicated by an operating point P4, regardless of whether or not the discharge lamp is illuminating. When the discharge lamp is extinguished by any cause other than a turn-off instruction, the discharge lamp is caused to return the transition-to-steady-illumination control (that is, it is returned to P2, and then transitioned P2→P3→P4).

The operation point P2 represents a predetermined frequency (a fixed value) within the frequency region fb; however, it may be the case that the frequency of the operation point is not constant (i.e., it varies according to a illumination condition of the discharge lamp).

In the case where the frequency is increased immediately after the power is turned on, the frequency is transitioned to the frequency region fb higher than f2 as indicated by the operating point P2 to allow versatility in the transition-to-illumination control. For instance, when only the control of the OCV is taken into account, a required output voltage can be obtained even when a frequency is regulated at a value lower than f1 immediately after the power is turned on. However, when the discharge lamp is extinguished for any reason after temporary illumination, on a condition that the operating point is within the frequency region fb, an OCV value can be increased by decreasing the frequency so as to cause the frequency to approach f1 from the higher frequency side. Therefore, a sequence of the transition-to-steady-illumination control for a case immediately after the power is turned on and a sequence of the transition-to-steady-illumination control for a case where the discharge lamp is extinguished after temporary illumination can be set identically without discrimination therebetween. Further, because a circuit section responsible for the control can be used in a shared manner, the configuration can be simplified as compared to that of a circuit where the transition-to-steady-illumination control is conducted depending on whether it is a case immediately after the power is turned on as opposed to a case where the discharge lamp is extinguished after temporary illumination.

Figure 3:
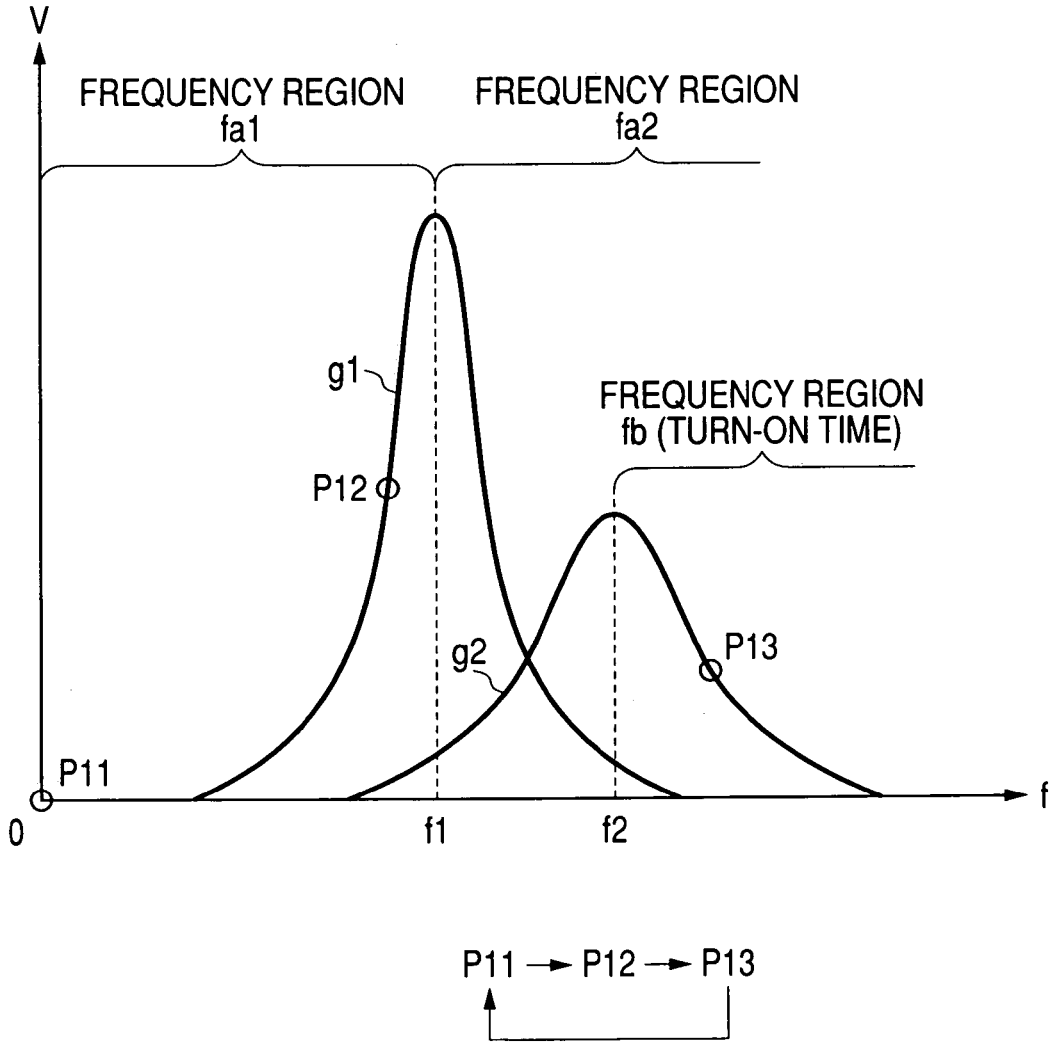
FIG. 3 is a diagram for describing another control mode.

Next, the control mode B will be described by reference to a graph shown in FIG. 3. FIG. 3 shows a resonance curve g1 of an extinction period of the discharge lamp, and a resonance curve g2 of an illumination period. The horizontal axis indicates a frequency "f," and the vertical axis indicates an output voltage V.

The symbols shown in the figure have the following meanings:

"P11": an operating point before the power is turned on;

"P12": an operating point indicating a time reaching a target value of the OCV during an extinction period of the discharge lamp; and "P13": an operating point after the discharge lamp is illuminated (within the frequency region fb).

"fa1," "fa2," and "fb" are as described previously.

In the control mode B, a control of the OCV is conducted so that the operating frequency is initially regulated at a frequency differing from f1, and caused to approach f1 gradually. For instance, immediately after the power is turned on or immediately after the discharge lamp is extinguished after temporary illumination, the OCV is caused to enter transition-to-steady-illumination control without the switching elements being operated (i.e., f=0 Hz). As the frequency approaches f1—which is a resonance frequency achieved in the extinction period—the output voltage attains a target value of the OCV in the frequency region fa1 (P11→P12). Subsequently, when the discharge lamp is started by the starter circuit 4, the control is transitioned to illumination control (electric power control). The illumination control is performed within the frequency region fb indicated by an operating point P13, regardless of whether or not the discharge lamp is illuminating. When the discharge lamp is extinguished for any cause other than a turn-off instruction, control returns to the transition-to-steady-illumination control. More specifically, back in P11, the frequency is forcibly set at an initial value (e.g., 0 Hz), and transitioned P11→P12→P13 again. At a stage where an operating point is caused to transition from P13 to P11 during the extinction period of the discharge lamp, the frequency "f" is decreased instantaneously (i.e., it does not cross over f1 slowly). Accordingly, the control of the OCV can be started from a safe frequency region.

In the control mode B, the transition-to-steady-illumination control can also be conducted without discriminating between a case where the discharge lamp is extinguished immediately after the power is turned on and a case where the discharge lamp is extinguished after temporary illumination. Various control modes can be implemented. Such control modes include one where, while the control mode A is adopted at a time of re-illumination, the frequency is caused to decrease from an operating point (a point corresponding to P2) within the frequency region fb so as to approach f1; accordingly, the OCV value is caused to increase, thereby reaching a target value; and after the discharge lamp is illuminated, the operating point is caused to transition to P13.

To compare the control modes A and B, for example, there is assumed a case where values of resonance frequencies f1 and f2 are higher than that of an amplitude modulation (AM) band and lower than that of a short wave or an frequency modulation (FM) band (for example, f1>2 MHz). The control mode A has an advantage that there is no possibility of radio noise because the frequency is transitioned to an initial frequency while quickly passing through the resonance frequencies f1 and f2 . Meanwhile, in the control mode B, when a frequency at an operating point P11 is regulated as 0 Hz, operation of the switching elements may be stopped. Therefore, the control mode B may employ a configuration simpler than that of the control mode A and is suitable for miniaturization of a circuit.

Next, a temporal restriction associated with the above-mentioned transition-to-steady-illumination control will be described.

As described above, a switching loss under a condition where the frequency is in the vicinity of f1 (especially on the lower side fa1) poses a serious problem. Therefore, a period during which the frequency remains in the vicinity of f1 is preferably set as short as possible. To achieve this, the frequency may be caused to transition, after a predetermined period has elapsed, to the frequency region fb from a time point where the discharge lamp is detected to be extinguished or the value of the OCV has attained a target value. The reason why an illumination point (i.e., breaking down) point is not set at a temporal starting point is that in the event that the discharge lamp fails to illuminate, the frequency may remain in the vicinity of f1 for a long time. In addition, other advantages also can be obtained, such that a determination of whether or not the lamp is illuminating does not have to be conducted quickly.

The invention can be implemented, for example, in the following configuration patterns:

(i) a configuration pattern 1 where the operating frequency of the switching elements is caused to transition temporarily to the frequency region fb after a predetermined period has elapsed since a start of the OCV control; and (ii) a configuration pattern 2 where the operating frequency of the switching elements is caused to transition temporarily to the frequency region fb after elapse of a period—which is fixed to a predetermined value—since a time point where the OCV is boosted to a predetermined voltage.

Figure 4:
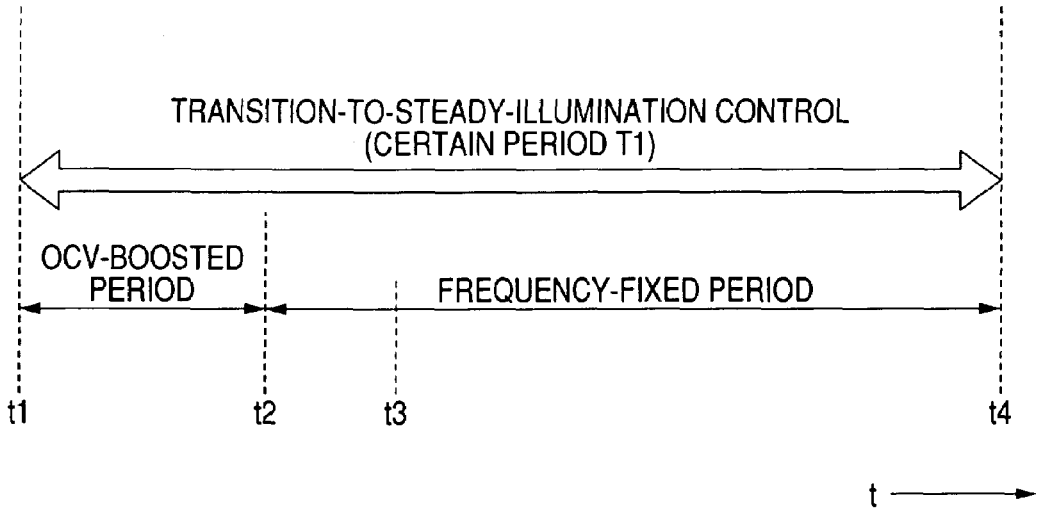
FIG. 4 is an explanatory diagram for a temporal restriction associated with a transition-to-steady-illumination control.

FIG. 4 is a descriptive view of the configuration pattern 1, and an arrow "t" indicates the passage of time.

A period T1 indicates a period during which transition of illumination is controlled (a given period) (hereinafter called a "transition-to-steady-illumination control period"), and a starting point t1 of T1 is assumed to be a time at which the discharge lamp is determined as having been extinguished. The transition-to-steady- illumination control is started upon a result of the determination. The period T1 includes a period (hereinafter referred to as "frequency-fixed period") required to cause the OCV boosted to attain a target voltage, and another period after the OCV has reached the target value for conducting switching control while the operating frequency is fixed to a certain value. In FIG. 4, t2 indicates a time at which the OCV has attained the target value; t3 indicates a time at which the discharge lamp is caused to illuminate (i.e., break down); and t4 indicates a time at which the period T1 has elapsed.

After a first period (a boost period) required to boost the OCV and a subsequent second period (frequency-fixed period), the operating frequency of the switching elements is regulated to a value higher than f2, while a period T1 which, includes the first and second periods, is set to be constant. After the period T1 has elapsed, the frequency is transitioned to the frequency region fb without fail, regardless of whether or not the discharge lamp is illuminating. Hence, the period during which the frequency remains in the vicinity of f1 can be regulated. For determining the duration of the period T1, the longer the period T1, the more reliably the discharge lamp can be illuminated. However, the longer the period T1, the greater a loss or a probability of failure. In consideration of these factors, the period T1 is desirably defined so as to satisfy both requirements.

Figure 5:
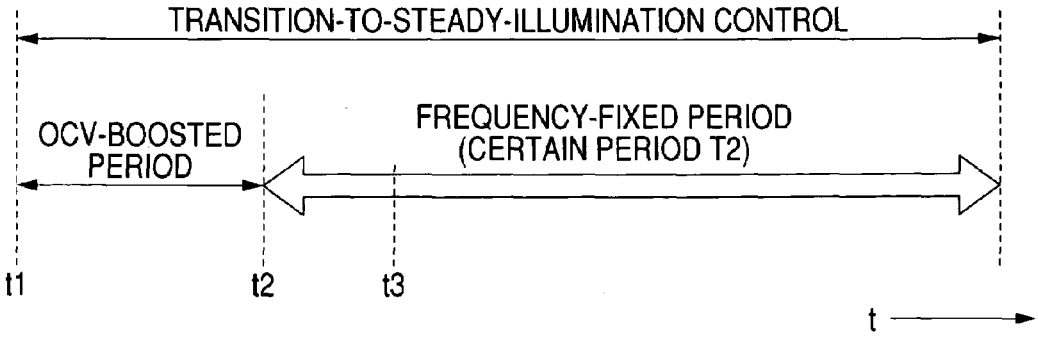
FIG. 5 is another explanatory diagram for a temporal restriction associated with a transition to steady-illumination control.

FIG. 5 is a descriptive view of the configuration pattern 2, which differs from the configuration pattern 1 in that the frequency-fixed period indicated by T2 is regulated to a predetermined period.

In the configuration pattern 2, the OCV is increased upon extinction of the discharge lamp. After the OCV has attained the target value, the operating frequency of the switching elements is fixed at a predetermined value over the predetermined period T2. Within the frequency-fixed period T2, a start-up signal is generated, and the start-up signal is supplied to the discharge lamp.

The duration of the period T2—where the operating frequency is fixed to a predetermined value—is set to be constant. After the period T2 has elapsed, the frequency is transitioned to the frequency region fb without fail, regardless of whether or not the discharge lamp is illuminating. Hence, the period during which the frequency remains in the vicinity of f1 can be regulated. The duration of the first period required to boost the OCV is not constant. However, in the configuration pattern 2, the duration of the period T2 can be defined at a desired value.

The frequency-fixed period is provided to increase the reliability of illuminating or re-illuminating the discharge lamp (for example, when the frequency is caused to transit directly to the frequency region fb immediately after the start-up signal is applied on the discharge lamp to thus illuminate the light, illumination may fail to be maintained stable; otherwise, re-illumination of the discharge lamp may be disabled in the case where the discharge lamp is extinguished after temporary illumination).

FIGS. 6 to 14 show specific examples of circuit configurations of the invention. Four circuit configurations are shown in correspondence to combinations of the control modes A and B and configuration patterns 1 and 2.

The control mode A and the circuit configuration 1 will be described first, by reference to FIGS. 6 to 12.

Figure 6:
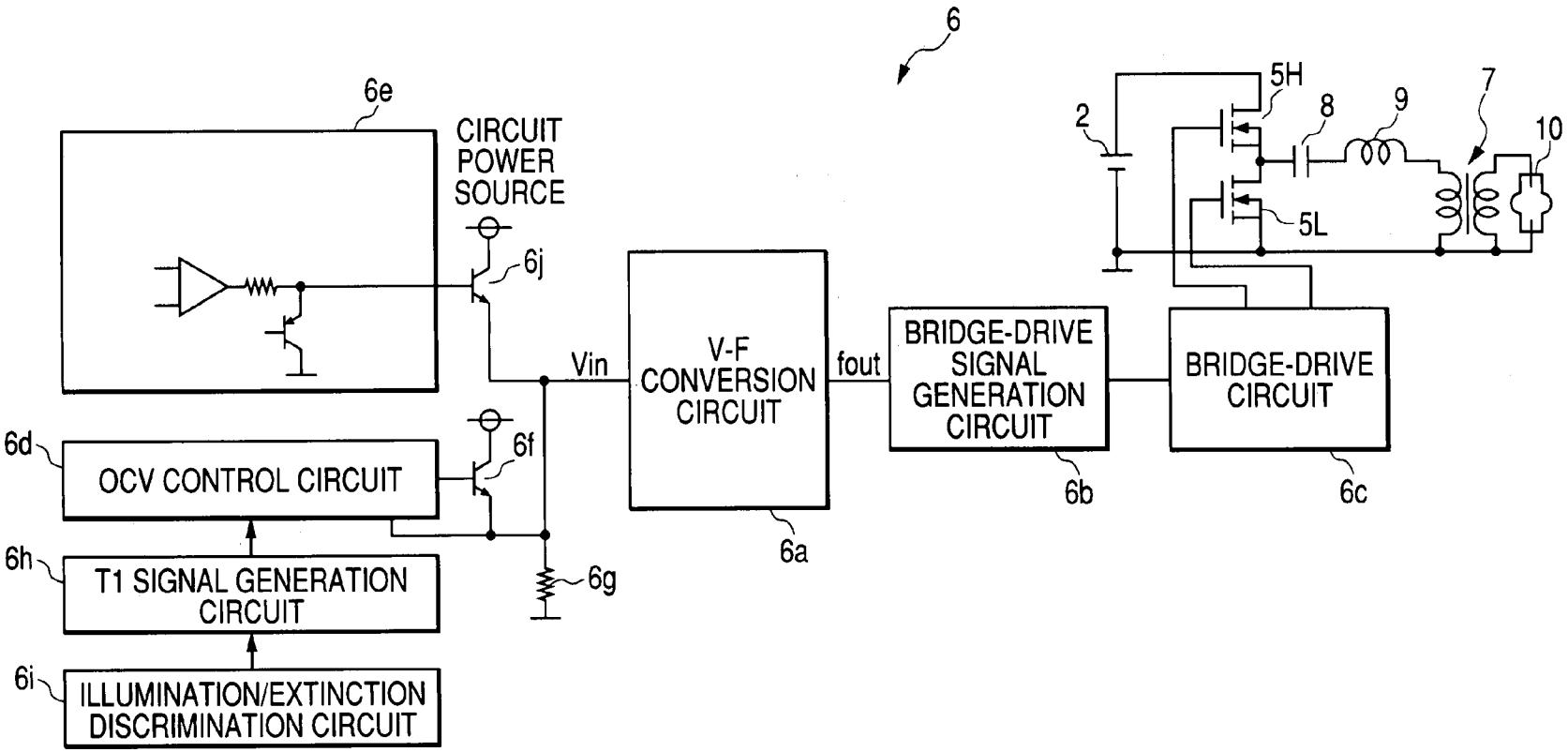

FIG. 6 shows an example circuit configuration of the control means 6. More specifically, FIG. 6 shows an example configuration employing a voltage-to-frequency conversion circuit (hereinafter referred to as "V-F conversion circuit") for changing a frequency depending on an input voltage. In FIG. 6, Vin indicates an input voltage of a V-F conversion circuit 6*a*, and fout indicates a frequency of an output voltage which is converted by the V-F conversion circuit 6*a*.

The V-F conversion circuit 6*a* has a control characteristic such that fout is increased with an increase in Vin. The output voltage is transmitted to a bridge drive signal generation circuit 6*b* which is located downstream. Further, the output signal is transmitted to respective control terminals of the switching elements 5H and 5L via a bridge drive circuit 6*c*. For instance, in a frequency region higher than the resonance frequency, the larger the value of Vin, the smaller the value of fout. As a result, when Vin is increased, the output power (or the output voltage) is controlled to be increased. In contrast, the smaller the value of Vin, the larger the value of fout. Accordingly, when the Vin value is decreased, the output power (or the output voltage) is suppressed and, thereby, decreased.

As described above, Vin is a voltage for controlling the frequency of the switching elements. In the example configuration, Vin is defined by outputs from an OCV control circuit 6*d* and a circuit for controlling power at the time of illumination 6*e* (hereinafter simply referred to as an "illumination power control circuit 6*e*").

The OCV control circuit 6*d* is a circuit for controlling a no-load voltage before illumination of the discharge lamp. An emitter output from an NPN transistor 6*f* which is provided on an output stage of the OCV control circuit 6*d* is supplied to a resistor 6*g*, and thereafter supplied to an input terminal of Vin.

A T1 signal generation circuit 6*h* is a circuit for generating a pulse signal having a width corresponding to the above-mentioned transition-to-steady-illumination period T1 in response to a signal from an illumination/extinction discrimination circuit 6*i*. The generated signal is transmitted to the OCV control circuit 6*d*.

The illumination power control circuit 6*e* is a circuit for controlling a transitional power input of the discharge lamp and a power input at a steady illumination state after the discharge lamp is illuminated. An emitter output from an NPN transistor 6*j* which is provided on an output stage of the illumination power control circuit 6*e* is sent to the V-F conversion circuit 6*a*. An arbitrary circuit configuration may be adopted for the illumination power control circuit 6*e*. Hence, a known configuration can be used (for example, there can be provided an error amplifier which performs calculations from a voltage detection signal or current detection signal of the discharge lamp, or a limiting circuit (for a lower limit) for limiting a controlled output so as to prevent the operating frequency from becoming lower than f2 during an illumination period of the discharge lamp).

Among an output from the OCV control circuit 6*d* and an output from the illumination power control circuit 6*e*, the output having a higher voltage is selected and supplied to the V-F conversion circuit 6*a* as a control voltage. Further, an output signal which is obtained through conversion of the control voltage is transmitted to the switching elements 5H and 5L as a control signal via the bridge drive signal generation circuit 6*b* and the bridge-drive circuit 6*c*.

FIGS. 1 shows a circuit configuration without a DC-DC converter. In this circuit configuration, power of the discharge lamp is controlled by means of converting a DC input to an AC voltage and boosting the resultant voltage through use of only a DC-AC conversion circuit 3. In a case where a path for detecting current flowing in the discharge lamp cannot be secured, it is better to detect a current value and a voltage value of the illumination lamp, by adding a winding to the resonance inductance element 9 and another winding to the AC conversion transformer 7.

For instance, as shown in FIG. 1, the auxiliary winding 11 forming a transformer together with the inductance element 9 is provided for detection of a current corresponding to a current flowing in the discharge lamp 10. An output from the auxiliary winding 11 is supplied to a current detection circuit 12. In other words, a current flowing in the discharge lamp is detected by means of the inductance element 9 and the auxiliary winding 11. The detection result is sent to the control means 6, and utilized for power control or discrimination of illumination/extinction of the discharge lamp.

A voltage applied on the discharge lamp 10 is detected from an output from the primary winding 7*p* or the secondary winding 7*s* of the AC conversion transformer 7, or from a detection winding 7*v* which is provided on the AC conversion transformer 7. In the example circuit, an output from the detection winding 7*v* is supplied to a voltage detection circuit 13, whereby a detection voltage corresponding to a voltage applied on the discharge lamp 10 through the voltage detection circuit 13 is obtained. Subsequently, the detection voltage is sent to the control means 6 and utilized for power control or discrimination of illumination/extinction of the discharge lamp.

Figure 7:
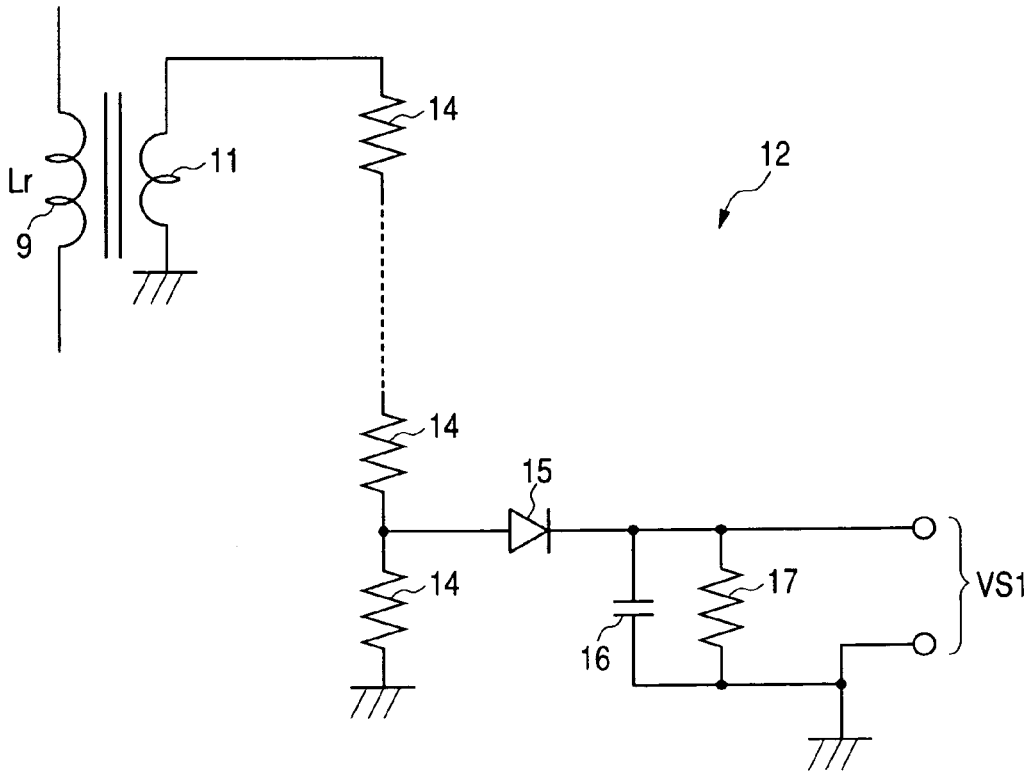

FIGS. 7 shows an example circuit configuration of the current detection circuit 12.

Voltage dividing resistors 14, 14, . . . are connected in series to one end (i.e., a terminal on a not-grounded side) of the auxiliary winding 11. One end of a voltage-dividing resistor 14 which is disposed at a lowermost stage is connected to a diode 15, and the other end is grounded. The divided-by-resistor voltage is supplied to an anode of the diode 15, and a cathode of the diode 15is connected to one of detection output terminals.

One end of a capacitor 16 is connected to the cathode of the diode 15, and the other end is grounded. A resistor 17 is connected in parallel with the capacitor 16.

As described above, a detector circuit of basic configuration can be used as the current detection circuit 12. Accordingly, a DC signal detected by the inductance element 9 and the auxiliary winding 11 is converted into an AC signal (see the detection voltage VS1 in FIG. 7).

By being subjected to voltage division using a plurality of resistor elements, a start-up signal generated by the starter circuit 4 can be suppressed to a level at which a detection voltage corresponding to a peak voltage of the start-up signal is negligible. Therefore, a circuit configuration for suppressing a high voltage generated at a start-up of the discharge lamp is very simple.

Figure 8:
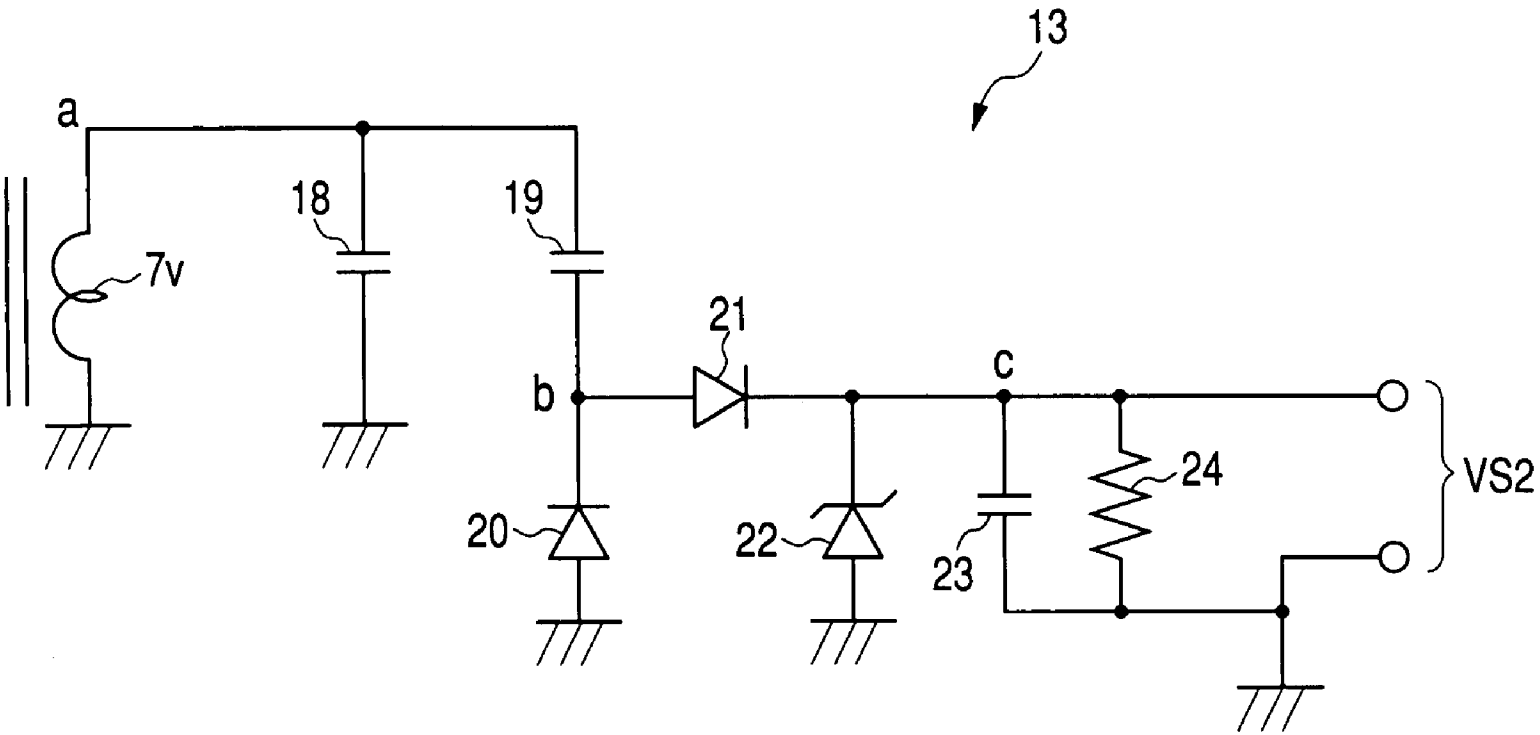

In addition, a current detection signal obtained through the current detection circuit 12 may be used for the OCV control circuit 6*d* to be described below FIG. 8 shows an example circuit configuration of the voltage detection circuit 13.

A terminal on a non-grounded side of the detection winding 7*v* (see point "a" in FIG. 8) is connected to one end of a capacitor 18, and the other end of the capacitor 18 is grounded. Further, a capacitor 19 which is provided in parallel with the capacitor 18 is connected to a cathode of a diode 20 and an anode of a diode 21. The anode of the diode 20 is grounded.

A cathode of the diode 21 is, while being connected to one of detection output terminals, connected to a cathode of a Zener diode 22 and one end of a capacitor 23. An anode of the Zener diode 22 and the other end of the capacitor 23 are grounded.

A resistor 24 is connected in parallel with the capacitor 23 to obtain a detection voltage indicated by VS2.

In the circuit, a voltage is, at start-up of the discharge lamp, applied on the detection winding 7*v* in a condition where a high-voltage pulse is applied thereon. However, the voltage can be detected by using the capacitors 19, 23 and the resistor 24. When magnitudes of the capacitors 19 and 23 are compared, the magnitude of the capacitor 23 is approximately one order of magnitude smaller than that of the capacitor 19. In addition, a resistance value of the resistor 24 is relatively large compared with the impedance of the capacitor 23. Therefore, a voltage applied on the point "b" (a connection point of the a node of the diode 21 and the capacitor 19) in FIG. 8 is determined by an impedance ratio between the capacitors 19 and 23.

After the discharge lamp is illuminated, an electric current is caused to flow only in one direction by an action of the diode 21. Accordingly, the capacitor 23 is charged gradually, thereby increasing voltages across the capacitor 23 (see the point "c" in FIG. 8). When a potential at one end of the detection winding 7*v* (a potential at the point "a" in FIG. 8) and a terminal potential (a potential at the point "c" in FIG. 8) of the capacitor 23 have become nearly equal, a current is caused not to flow into the capacitor 19. That is, a detection voltage under a steady illumination condition of the discharge lamp can be detected without voltage division by the capacitors 19 and 23 even when a voltage applied on the detection winding 7*v* is small. Hence, a required accuracy can be guaranteed.

Meanwhile, the capacitor 18 at a first stage is provided for absorbing a re-striking voltage. The Zener diode 22 functions as a clamping element for suppressing a high voltage caused by generation of a start-up pulse voltage, and serves as a limiting circuit for a surge voltage entailed by the generation of the start-up pulse voltage.

Figure 9:
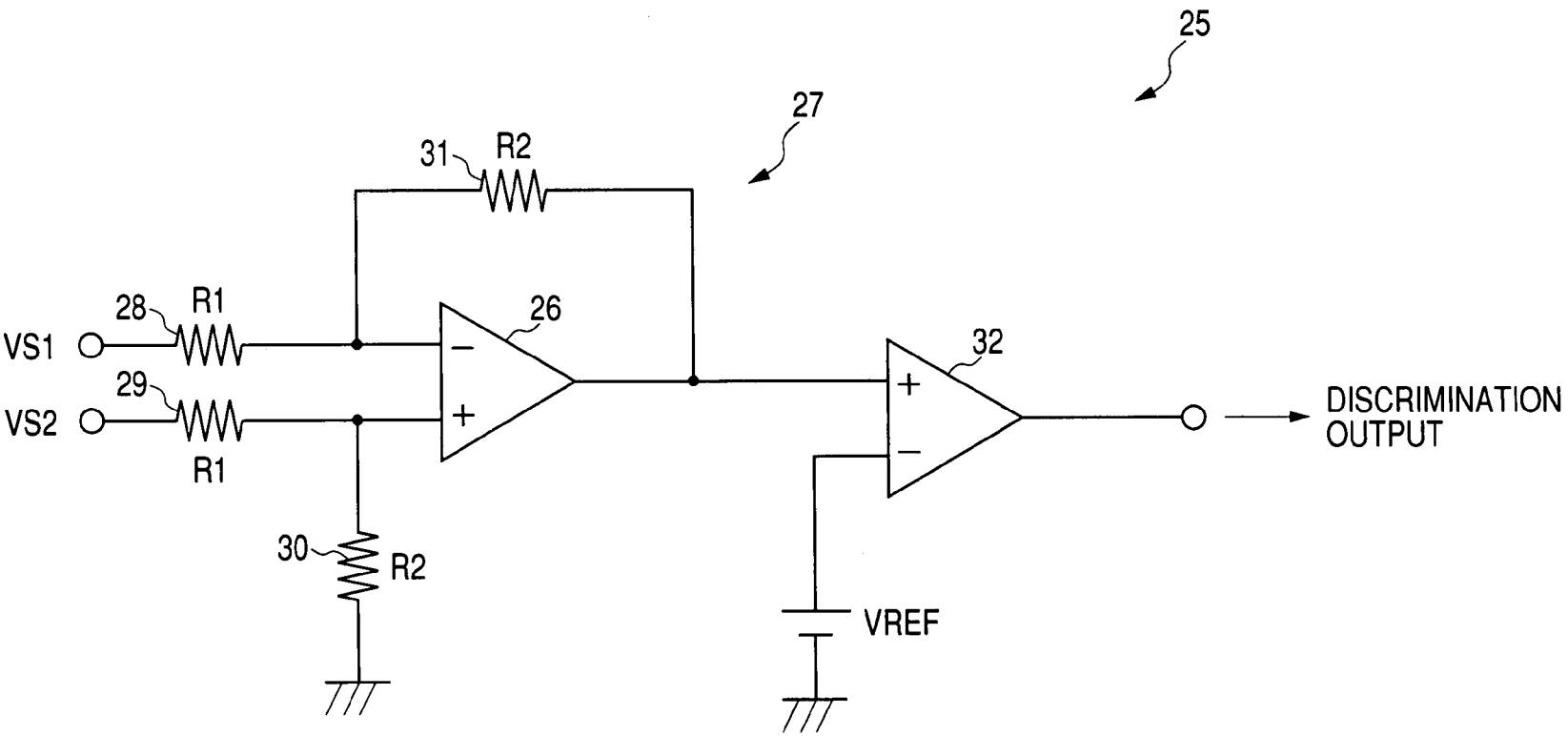

FIG. 9 is a circuit diagram showing an example configuration 25 of the illumination/extinction discrimination circuit 6*i*.

The detection voltage VS1 obtained from the current detection circuit 12 and the detection voltage VS2 obtained from the voltage detection circuit 13 are supplied to a subtraction circuit 27 which uses an operational amplifier 26. More specifically, VS1 is supplied to an inverting input terminal of the operational amplifier 26 via a resistor 28, and VS2 is supplied to a non-inverting input terminal of the operational amplifier 26 via resistors 29 and 30. Further, one end of the resistor 30 is connected to the non-inverting input terminal of the operational amplifier 26, and the other end of the resistor 30 is grounded. A resistor 31 is provided between the inverting input terminal of the operational amplifier 26 and an output terminal of the operational amplifier 26. Furthermore, resistance values of the resistors 28 and 29 (denoted as "R1") are set to be identical with each other, and resistance values of the resistors 30 and 31 (denoted as "R2") are set to be identical with each other.

The operational amplifier 26 sends an output ((R2/R1)·(VS2−VS1))—which is proportional to a difference between VS2 and VS1—to a positive input terminal of a comparator 32 provided at a subsequent stage thereof. A predetermined reference voltage (denoted as "VREF") is supplied to a negative input terminal of the comparator 32. Whether or not the discharge lamp is illuminating is discriminated by comparing a calculation result—which is proportional to (VS2−VS1)—with VREF. More specifically, in the case where a level of the output from the operational amplifier 26 is VREF or higher, an output signal from the comparator 32 reaches a high (H) level, which indicates that the discharge lamp is extinguished. In contrast, when the level of the output from the operational amplifier 26 is lower than VREF, the output signal from the comparator 32 falls to a low (L) level, which indicates that the discharge lamp is in an illuminating state.

The example configuration 25 is provided with a circuit for subtracting a current detection value from a voltage detection value of the discharge lamp; and a circuit for comparing the subtraction result with a threshold voltage value. Hence, an illumination/extinction discrimination signal (denoted as "Si") of the discharge lamp is obtained as a binary signal.

Figure 10:
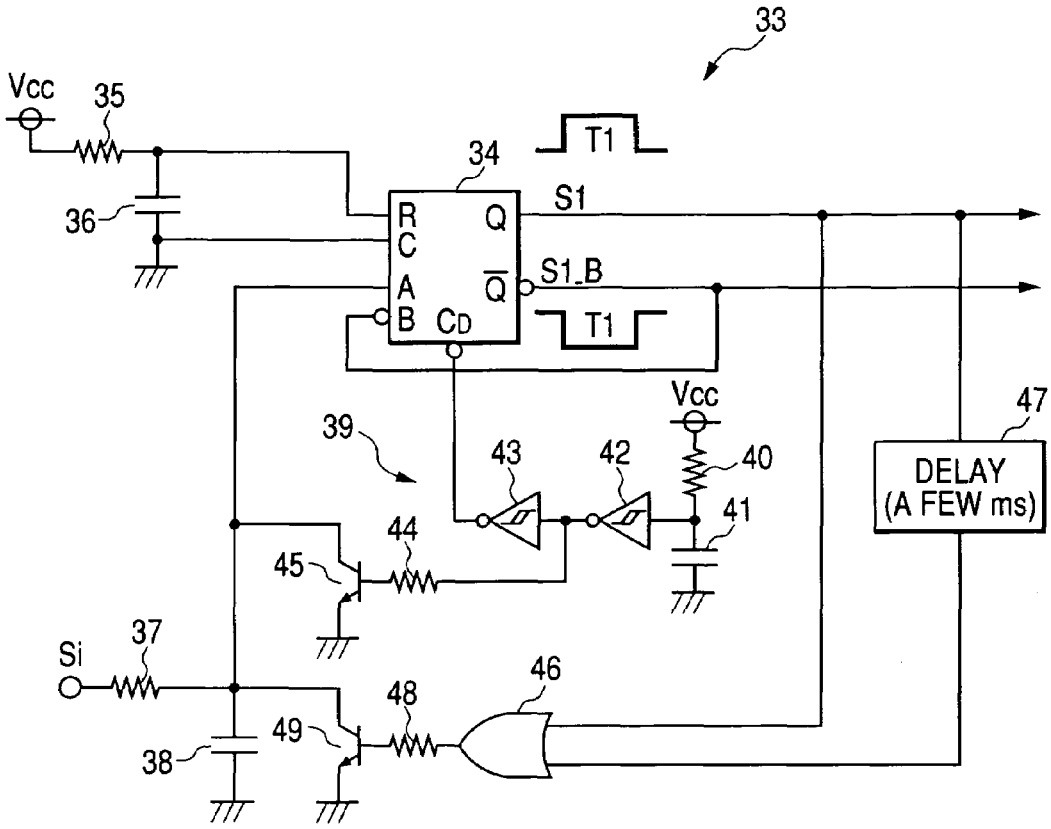

FIG. 10 is a circuit diagram showing an example circuit configuration 33 of the T1 signal generation circuit 6*h*.

The example configuration 33 employs a monostable multivibrator IC, and a pulse signal S1 which indicates the predetermined period T1, and a pulse signal S1_B which is an inversion signal of S1 are generated. Further, the signals S1 and S1_B are supplied to the OCV control circuit 6*d* described below . More specifically, when the illumination/extinction discrimination signal Si reaches an H level during the extinction period of the discharge lamp, the H level signal is input to the monostable multivibrator 34 via an RC filter (a resistor 37 and a capacitor 38). Thereafter, the signals S1 and S1_B having a width corresponding to the transition-to-steady-illumination period T1 are output.

A predetermined power supply voltage Vcc is supplied to a terminal R of the monostable multivibrator 34 via a resistor 35. Further, one end of a capacitor 36 is connected to the resistor 35 and the terminal Rand the other end of the capacitor 36 is connected to a terminal C and to ground. The duration of the period T1 is defined by a time constant which is set by use of the resistor 35 and the capacitor 36.

A terminal A (input terminal) of the monostable multivibrator 34 is connected to a connection point between the resistor 37 and the capacitor 38. The illumination/extinction discrimination signal Si is supplied to one end of the resistor 37, and the other end of the resistor 37 is grounded via the capacitor 38. Meanwhile, when the discharge lamp is determined to be extinguished, the illumination/extinction discrimination signal Si indicates the H level, and when the discharge lamp is determined to be illuminating, the illumination/extinction discrimination signal Si indicates an L level.

At a time of initialization, a POR signal from a power-on-reset (denoted as "POR") circuit 39 is supplied to a terminal CD (active low input) of the monostable multivibrator 34. In the example configuration 33, the POR circuit 39 is configured as a CR circuit which constitutes a resistor 40 and a capacitor 41; and two Schmitt-trigger-type NOT gates 42 and 43. The power supply voltage Vcc is supplied to one end of the resistor 40, and the other end of the resistor 40 is grounded via the capacitor 41. An input terminal of the NOT gate 42 at the antecedent stage is connected to a point between the resistor 40 and the capacitor 41. An output signal from the NOT gate 42 is supplied to the terminal CD via the NOT gate 43 at the subsequent stage. Meanwhile, an output signal from the NOT gate 42 is supplied to a base of a grounded-emitter NPN transistor 45 via a resistor 44. Further, a collector of the transistor 45 is connected to one end of the capacitor 38 (i.e., the transistor 45 is temporarily in the on state at the time of initialization).

The pulse signal Si is output from a terminal Q of the monostable multivibrator 34. The pulse signal S1 has a pulse width which is identical with the period T1 from a moment when the discrimination signal S1 has reached an H level. Further, the pulse signal S1_B is output from a terminal Q bar (in FIG. 10, the terminal Q bar is indicated by placing a bar on Q), and is also supplied to a terminal B (active low input).

The pulse signal S1 is supplied to one of the input terminals of a two-input OR gate 46, and is also supplied to the other input terminal of the OR gate 46 via a delay section (delay elements, or the like) 47. An output signal from the OR gate 46 is supplied to a base of an NPN transistor 49 via a resistor 48. The transistor 49 is emitter-grounded, and a collector of the transistor 49 is connected to one end of the capacitor 38. Meanwhile, the above circuit section can preventing harmful effects caused by erroneous discrimination of illumination/extinction. That is, in the frequency region fa2 (see FIG. 2), when a frequency is caused to transition to the frequency region fb after the discharge lamp is illuminated, voltage detection or current detection of the discharge lamp falls in an unstable state instantaneously. This state may cause an erroneous determination of illumination/extinction. For example, in the case where the discharge lamp is determined to be extinguished despite actually being illuminating, the frequency maybe transitioned to the frequency region fa2. Accordingly, to avoid such a problem, the transistor 49 is caused to be in the on state so as to mask the illumination/extinction discrimination signal Si (i.e., the signal S1 is forcibly brought into the L level) for several milliseconds after a transition to the frequency region fb.

In the example configuration 33, the CR time constant is used for setting the period T1. However, the configuration is not so limited , and there may be employed a configuration such that an internal basic clock is counted by a counter.

Figure 11:
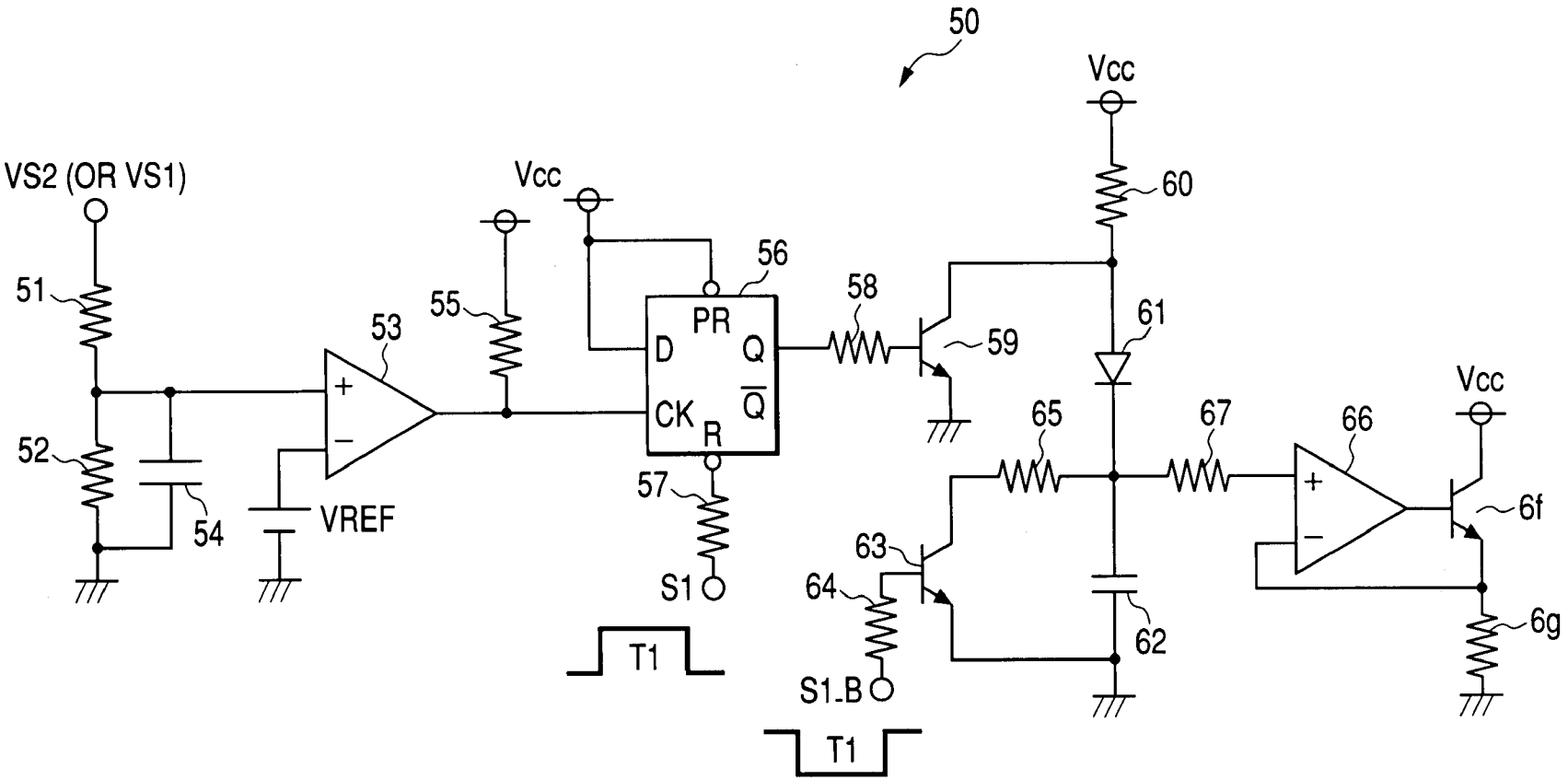

FIG. 11 is a circuit diagram showing an example configuration 50 of the OCV control circuit 6*d*.

The detection voltage VS2 (or VS1) is divided by resistors 51 and 52, and supplied to a positive input terminal of a comparator 53. A predetermined reference voltage (denoted as "VREF") is supplied to a negative input terminal of the comparator 53, whereby a detection value of VS2 (or VS1) is compared with VREF. A capacitor 54 is connected in parallel with the resistor 52. A pull-up resistor 55 is connected to an output terminal of the comparator 53.

The predetermined power supply voltage Vcc is supplied to a terminal D of a D flip-flop 56 and a preset (PR) terminal of active low input of the D flip-flop 56. An output signal from the comparator 53 is supplied to a clock-signal-input terminal (CK). Further, the pulse signal S1 is supplied to a reset (R) terminal as an active low input via a resistor 57.

An output signal Q from the D flip-flop 56 is supplied to a base of a grounded-emitter NPN transistor 59 via a resistor 58. A collector of the transistor 59 is connected to a circuit power supply terminal (power supply voltage Vcc) via a resistor 60.

An anode of a diode 61 is connected to one end of the resistor 60, and a cathode of the diode 61 is connected to one end of a capacitor 62. The other end of the capacitor 62 is grounded.

The signal S1_B is supplied to a base of a grounded-emitter NPN transistor 63 via a resistor 64. A collector of the transistor 63 is connected to a portion between the diode 61 and the capacitor 62 via a resistor 65.

An operational amplifier 66 and an NPN transistor 6*f*—which is provided at an output stage of the operational amplifier 66—form a buffer. A non-inverting input terminal of the operational amplifier 66 is connected to a point between the diode 61 and the capacitor 62 via a resistor 67. Further, an output terminal of the operational amplifier 66 is connected to a base of the transistor 6*f*. An emitter of the transistor 6*f* is connected to the inverting input terminal of the operational amplifier 66, and also grounded via a resistor 6*g*. A power supply voltage Vcc is supplied to the collector of the transistor 6*f*.

In the circuit, when power is turned on or when the discharge lamp is illuminating, the pulse signal S1 falls to the L level, and the D flip-flop 56 is reset. As a result, the output signal Q falls to an L level, and the transistor 59 enters the off state. In addition, because the pulse signal S1_B is at an H level, the transistor 63 enters an on state, and a terminal potential of the capacitor 62 falls to an L level. Therefore, an output (see an emitter potential of the transistor 6*f*) of the circuit falls to an L level.

When the discharge lamp is not illuminating, the pulse signal S1 reaches the H level, and the D flip-flop 56 is released from the reset condition. Further, because the signal S1_B falls to an L level and the transistor 63 enters the off state. Hence, discharging from the capacitor 62 is stopped, and charging of the capacitor 62 is started via the resistor 60 and the diode 61. An emitter potential of the transistor 6*f* is increased as the capacitor is charged. Accordingly, the frequency is gradually decreased. More specifically, the frequency is gradually decreased within the frequency region fa2 (see FIG. 2), and the OCV value is gradually increased. When the OCV attains a target value (see P3 in FIG. 2), an output from the comparator 53 reaches an H level. That is, when a detection voltage which is divided by the resistors 51 and 52 reaches VREF or higher, the D flip-flop 56 is set by the output signal from the comparator 53, and the output signal Q thereof is transitioned to an H level. Hence, the transistor 59 enters the on-state, and charging of the capacitor 62 is stopped. Therefore, a terminal potential of the capacitor 62 and the emitter potential of the transistor 6*f* are fixed. As a result, the frequency value is maintained constant. When the transition-to-steady-illumination period T1 has elapsed, the signal S1 falls to an L level; the D flip-flop 56 is reset; the output signal Q is transited to the L level; and the transistor 59 enters the off state. When the signal S1_B reaches the H level and the transistor 63 is turned on, the capacitor 62 is discharged, whereby the terminal potential falls to an L level. Accordingly, the emitter potential of the transistor 6*f* falls to the L level, and the frequency is transited to the frequency region fb after completion of the frequency-fixed period.

Figure 12:
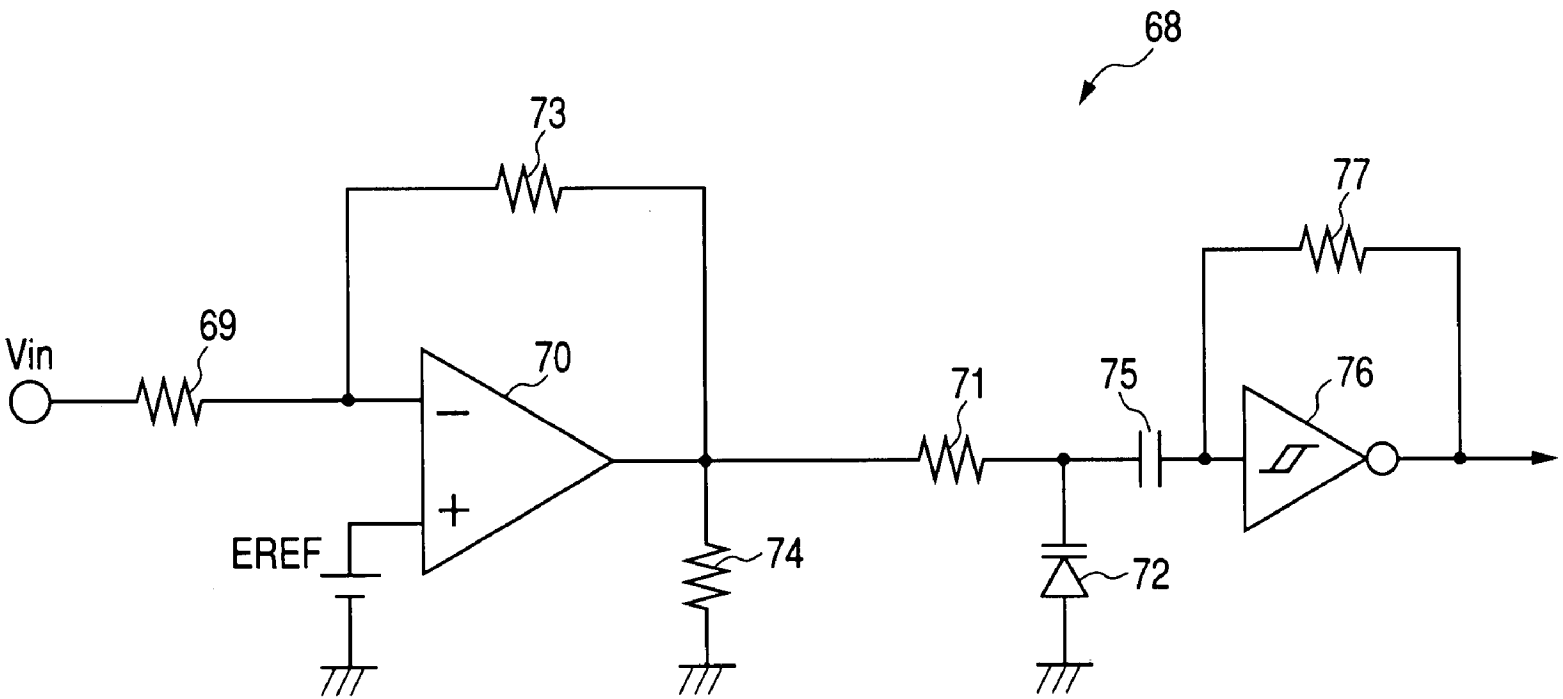

FIG. 12 shows the principal section of an example configuration 68 of the V-F conversion circuit 6*a*.

The input voltage Vin is supplied to an inverting input terminal of an operational amplifier 70 via a resistor 69. A predetermined reference voltage EREF is supplied to a non-inverting input terminal of the operational amplifier 70. An output signal from the operational amplifier 70 is supplied to a voltage-variable capacitance diode 72 via a resistor 71. Further, one end of a resistor 73 is provided between the inverting input terminal and an output terminal of the operational amplifier 70. One end of a resistor 74 is connected to the output terminal of the operational amplifier 70, and the other end of the resistor 74 is grounded.

A cathode of the voltage-variable capacitance diode 72 is connected to a portion between the resistor 71 and a capacitor 75, and an anode of the voltage-variable capacitance diode 72 is grounded. Further, an input terminal of a Schmitt-trigger-type NOT gate 76 is connected to the cathode of the voltage-variable capacitance diode 72. A resistor 77 is connected in parallel with the NOT gate 76. A frequency-variable oscillating circuit is formed from the above elements, whereby an output pulse from the NOT gate 76 is sent to the circuit section 6*b* at the subsequent stage (more specifically, the bridge drive signal generation circuit 6*b* generates drive signals for controlling the respective switching elements on the basis of pulse signals, and supplies the drive signals to the bridge drive circuit 6*c*; however, a known configuration may be used for the circuits 6*b* and 6*c*, and drawings and descriptions thereof are omitted.).

In the example configuration 68, when a level of Vin is increased (decreased), an output potential from the operational amplifier 70 is decreased (increased), thereby increasing (decreasing) a capacitance of the voltage-variable capacitance diode 72. As a result, a frequency of the output pulse is decreased (increased).

Figure 13:
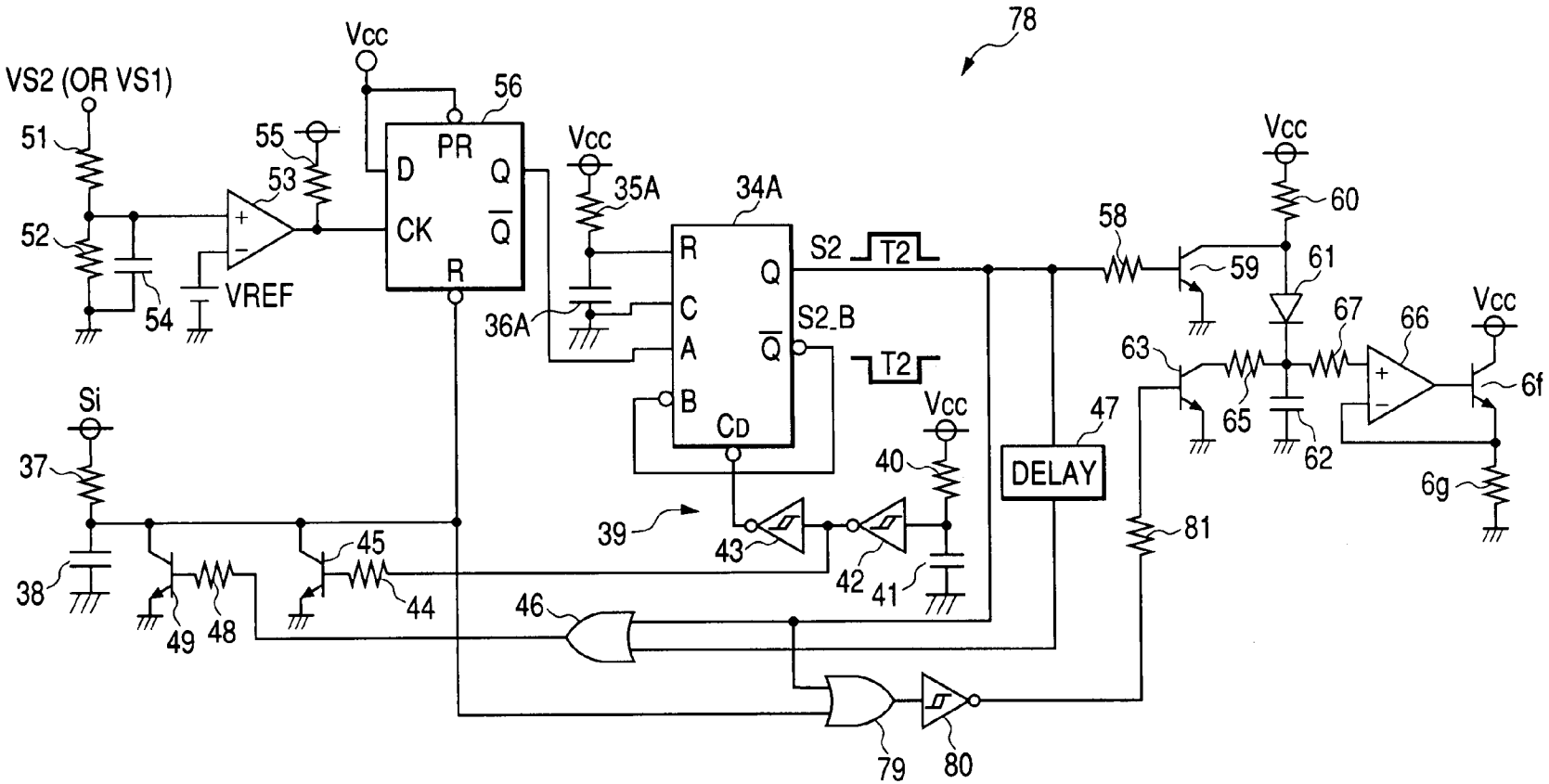

Next, the control mode A and the configuration pattern 2 will be described by reference to FIG. 13. FIG. 13 shows an example configuration 78 of the OCV control circuit and a T2 signal generation circuit associated with the frequency-fixed period. An output voltage from the T2 signal generation circuit 78 is sent to the V-F conversion circuit 6*a*. In the example configuration 78, portions which are functionally identical with those of FIG. 10 or 11 are denoted by the same reference numerals.

The detection voltage VS2 (or VS1) is divided by the resistors 51 and 52, and supplied to a non-inverting input terminal of the comparator 53. The predetermined reference voltage VREF is supplied to an inverting input terminal of the comparator 53, and the detection value of VS2 (or VS1) is compared with VREF. Meanwhile, the capacitor 54 is connected in parallel with the resistor 52. The pull-up resistor 55 is connected to an output terminal of the comparator 53.

The predetermined power supply voltage Vcc is supplied to the terminal D and the terminal PR of the D flip-flop 56. An output signal from the comparator 53 is supplied to the clock-signal-input terminal CK. Further, the illumination/extinction discrimination signal S1 is supplied to the terminal R as an active low input via the resistor 37 and the capacitor 38.

The output signal Q from the D flip-flop 56 is supplied to a terminal A of a monostable multivibrator 34A at a subsequent stage.

In the example configuration 78, a signal S2—which is a pulse signal having the same width with the predetermined period T2—and a signal S2_B—which is an inverted signal of S2—are generated by the monostable multivibrator 34A.

The predetermined power supply voltage Vcc is supplied to a terminal R of the monostable multivibrator 34A via a resistor 35A. Further, one end of a capacitor 36A is connected to the resistor 35A and the terminal R. The other end of the capacitor 36A is connected to a terminal C and is also grounded. The duration of the period T2 is defined by a time constant which is set by use of the resistor 35A and the capacitor 36A.

At a time of initialization, a POR signal from the POR circuit 39 is supplied to a terminal CD (active low input) of the monostable multivibrator 34A. The POR circuit 39 comprises the resistor 40, the capacitor 41, and the two Schmitt-trigger-type NOT gates 42 and 43. An input terminal of the NOT gate 42 is connected to a point between the resistor 40 and the capacitor 41. An output signal from the NOT gate 42 is supplied to the terminal CD via the NOT gate 43. The output signal from the NOT gate 42 is supplied to the base of the grounded-emitter NPN transistor 45 via the resistor 44. Further, the collector of the transistor 45 is connected to one end of the capacitor 38.

The pulse signal S2 is output from a terminal Q of the monostable multivibrator 34A. The pulse signal S2 is caused to have a pulse width which is identical with the period T2 from a moment the OCV has attained the target value. Further, the pulse signal S2_B is output from a terminal Q bar (in FIG. 13, the terminal Q bar is indicated by placing a bar over Q), and is also supplied to a terminal B (active low input).

The pulse signal S2 is supplied to the base of the grounded-emitter NPN transistor 59 via the resistor 58. The collector of the transistor 59 is connected to a circuit power supply terminal (power supply voltage Vcc) via the resistor 60. Further, the pulse signal S2 is supplied to one of the input terminals of the OR gate 46, and is also supplied to other input terminal of the OR gate 46 via the delay section 47. The output signal from the OR gate 46 is supplied to the base of the grounded-emitter NPN transistor 49 via the resistor 48. The collector of the transistor 49 is connected to one end of the capacitor 38. The above circuit section can help prevent harmful effects caused by erroneous discrimination of illumination/extinction.

The diode 61 is connected to the resistor 60. The cathode of the diode 61 is connected to one end of the capacitor 62, and the other end of the capacitor 62 is grounded.

The collector of the grounded-emitter NPN transistor 63 is connected to a portion between the diode 61 and the capacitor 62 via the resistor 65. Further, an output signal from a two-input OR gate 79 is supplied to a base of the transistor 63 via a Schmitt-trigger-type NOT gate 80 and a resistor 81. The pulse signal S2 is supplied to one of input terminals of the OR gate 79, and the illumination/extinction discrimination signal S1 is supplied to the other terminal via the CR circuit (i.e., the resistor 37 and the capacitor 38).

The operational amplifier 66 and the NPN transistor 6*f*—which is provided at the output stage of the operational amplifier 66—form a buffer. The non-inverting input terminal of the operational amplifier 66 is connected to a point between the diode 61 and the capacitor 62 via the resistor 67. Further, the output terminal of the operational amplifier 66 is connected to the base of the transistor 6*f*. The emitter of the transistor 6*f* is connected to the inverting input terminal of the operational amplifier 66, and also grounded via the resistor 6*g*. An emitter output from the transistor 6*f* is sent to the V-F conversion circuit 6*a* at the subsequent stage as Vin.

In the circuit, when power is on or when the discharge lamp is illuminating, the illumination/extinction discrimination signal Si falls to the L level, and the D flip-flop 56 is reset. As a result, the output signal Q falls to the L level; the output signal Q from the monostable multivibrator 34A falls to the L level; and the transistor 59 is in the off state. In addition, an L level signal output from the OR gate 79 is converted to an H level signal through the Schmitt-trigger-type NOT gate 80. Accordingly, the transistor 63 enters an on state, and a terminal potential of the capacitor 62 falls to the L level. Therefore, an output (refer to the emitter potential of the transistor 6*f*) from the circuit falls to the L level.

When the discharge lamp is not illuminating, the illumination/extinction discrimination signal Si reaches the H level, and the D flip-flop 56 is released from the reset condition. Simultaneously, the output signal from the OR gate 79 reaches the H level, then falls to the L level after passing through the NOT gate 80. Accordingly, the transistor 63 enters the off state. Charging of the capacitor 62 is started to increase the voltage of the capacitor 62. When the OCV value attains a target value, an H level signal output from the comparator 53 is input to the D flip-flop 56. The output signal Q from the D flip-flop 56 reaches the H level (i.e., is latched) and is supplied to the monostable multivibrator 34A. As a result, the pulse signal S2 having a pulse width identical with the predetermined time T2 is output from the terminal Q, and the transistor 59 enters the on state. Hence, the charging of the capacitor 62 is inhibited. The transistor 63 is kept in the off state. Accordingly, a terminal potential of the capacitor 62 and an emitter potential of the transistor 6*f* are fixed. As a result, the frequency value is maintained constant. Meanwhile, during the above operation, latching by the D flip-flop 58 is prevented (i.e., disabled)

After the predetermined period T2 has elapsed, the pulse signal S2 falls to an L level. Further, after elapse of a period set by the delay section 47, the D flip-flop 56 is reset. The frequency, which has been through the frequency-fixed period, is to be transited to the frequency region fb. However, when the discharge lamp is extinguished after temporary illumination, the latching is enabled and the control reenters transition-to-illumination control.

Figure 14:
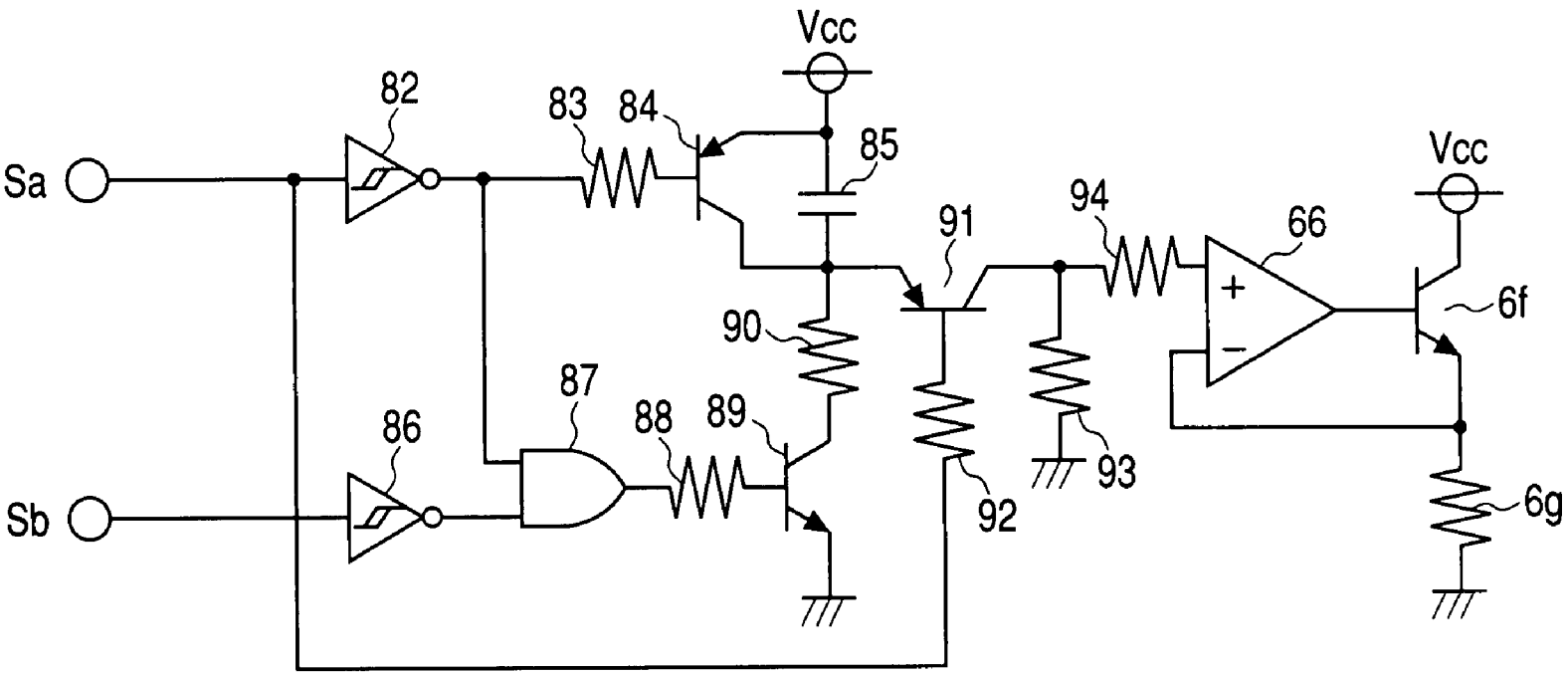

Next, the control mode B will be described by reference to FIG. 14. FIG. 14 shows only portions which differ from those of the circuit configuration shown in FIG. 11 or 13. In the following description of the control mode B, portions which are functionally identical with those of FIG. 11 or 13 are denoted by the same reference numerals.

A signal Sa in FIG. 14 indicates a signal supplied by the base of the transistor 63 in FIG. 11 or 13, and a signal Sb indicates the signal supplied by the base of the transistor 59 in FIG. 11 or 13.

The signal Sa is supplied to a base of a PNP transistor 84 via the Schmitt-trigger-type NOT gate 82 and a resistor 83. The power supply voltage Vcc is supplied to an emitter of the transistor 84. A capacitor 85 is provided at a point between the emitter and a collector of the transistor 84.

The signal Sb is supplied to one of input terminals of a two-input AND gate 87 via a Schmitt-trigger-type NOT gate 86. An output signal from the NOT gate 82 is supplied to the other input terminal of the AND gate 87. Further, an output signal from the AND gate 87 is supplied to a base of an NPN transistor 89 via a resistor 88. An emitter of the transistor 89 is grounded, and a collector of the transistor 89 is connected to the capacitor 85 and a collector of the PNP transistor 84 via a resistor 90.

An emitter of a PNP transistor 91 is connected to a connecting point between the capacitor 85 and the resistor 90. The signal Sa is supplied to a base of the PNP transistor 91 via a resistor 92. Further, a collector of the transistor 91 is connected to a connecting point between resistors 93 and 94. One end of the resistor 93 is grounded, and the other end of the resistor 93 is connected to a non-inverting input terminal of the operational amplifier 66 via the resistor 94.

The operational amplifier 66 and the NPN transistor 6*f* form a buffer. Further, an output terminal of the operational amplifier 66 is connected to a base of the transistor 6*f*. An emitter of the transistor 6*f* is connected to an inverting input terminal of the operational amplifier 66, and also grounded via the resistor 6*g*. An emitter output from the transistor 6*f* is sent to the V-F conversion circuit 6*a* at the subsequent stage as Vin.

In the control mode B and the configuration pattern 1, a output signal Q from the D flip-flop 56 in FIG. 11 is supplied to the NOT gate 86 in FIG. 14 as the signal Sb. Further, the signal S1_B is supplied to the NOT gate 82 and a base of the transistor 91 in FIG. 14 as the signal Sa.

When the discharge lamp is illuminating, the signal Sa is at an H level, and the transistor 84 enters the on state on the basis of an L level signal obtained through the NOT gate 82. Accordingly, the capacitor 85 is discharged and the charge of the capacitor 85 becomes zero. Further, during a boosting period of the OCV at the time of extinction of the discharge lamp, the signal Sa falls to an L level, and the transistor 84 is in an OFF state. In contrast, during a period until the OCV attains a target value, the signal Sb is at an L level, and the transistors 89 and 91 are in an on state. Therefore, the capacitor 85 is charged, and voltages across the capacitor 85 are increased. As a result, an input voltage to the operational amplifier 66 is gradually decreased. Meanwhile, at an instant when the OCV boosting period is started after the discharge lamp has been extinguished, the circuit power supply voltage Vcc is input to the operational amplifier 66, and the emitter potential of the transistor 6*f* is increased. Hence, the operating frequency of the switching elements is decreased steeply.

Subsequently, when the OCV attains a target value, the signal Sb reaches an H level. Accordingly, an output signal from the AND gate 86 falls to an L level, whereby the transistor 89 enters the off state. The frequency is transitioned to a frequency-fixed period, in which only the transistor 91 is caused to be in the on state, and an input voltage—which is supplied to the operational amplifier 66—is maintained constant while voltages across the capacitor 85 are maintained at the same values. That is, the operating frequency of the switching elements is maintained at a constant value without changing the emitter potential of the transistor 6*f*. However, a resistance value of the resistor 93 must be set at a sufficiently large value (so as to increase a time constant which is determined by the resistance value and an electrostatic capacity of the capacitor 85).

After the predetermined period T1 has elapsed, the signal Sa reaches the H level, whereby the transistor 84 enters the on state, and the capacitor 85 is discharged. At this time, the transistors 89 and 91 enter the off state.

Next, in the control mode B and the configuration pattern 2, a output signal Q from the monostable multivibrator 34A in FIG. 13 is supplied to the NOT gate 86 in FIG. 14 as the signal Sb. Further, an output signal from the NOT gate 80 in FIG. 13 is supplied to the NOT gate 82 and a base of the transistor 91 in FIG. 14 as the signal Sa.

When the discharge lamp is illuminating, an output signal from the OR gate 80 in FIG. 13 is at an L level. Therefore, the signal Sa is at the H level, the transistor 84 enters the on state on the basis of an L level signal obtained through the NOT gate 82, and the capacitor 85 is discharged. Further, when the discharge lamp is discriminated to be extinguished, during a period until the OCV is increased to attain a target value, and the signal Sa is at the L level. Hence, the transistors 89 and 91 enter the on state. Therefore, the capacitor 85 is charged, and voltages across the capacitor 85 are increased. As a result, an input voltage to the operational amplifier 66 is gradually decreased. Meanwhile, at an instant when the OCV boosting period is started after the discharge lamp is extinguished, the circuit power supply voltage Vcc is input to the operational amplifier 66, and an emitter potential of the transistor 6*f* is increased. Thereby, the operating frequency of the switching elements is decreased steeply.

When the OCV is increased to attain the target value during an extinction period of the discharge lamp, the signal S2 in FIG. 13 reaches an H level. Therefore, the OR gate 79 in FIG. 13 reaches the H level, and the signal Sa falls to the L level. Accordingly, an output signal from the AND gate 87 falls to an L level, whereby the transistor 89 enters the off state. The frequency is transited to the frequency-fixed period, where only the transistor 91 is caused to be in the on state, and an input voltage—which is supplied to the operational amplifier 86—is maintained constant while voltages across the capacitor 85 are maintained at the same values. That is, the operating frequency of the switching elements is maintained at a constant value without changing the emitter potential of the transistor 6*f*.

After the predetermined period T2 has elapsed, the signal Sa reaches the H level, whereby the transistor 84 enters the on state, and the capacitor 85 is discharged. At this time, the transistors 89 and 91 enter the off state.

There may be provided a circuit or the like for stopping an operation of the switching elements in order to set the operating frequency of the switching elements to 0 Hz with reliability, at a start of transition to the OCV boosting period after the discharge lamp is determined to be extinguished.

Other implementations are within the scope of the claims.

What is claimed is:

1. A discharge lamp illumination circuit comprising:

a DC-AC conversion circuit which effects AC conversion and boosting upon receipt of a DC input; and a starter circuit for supplying a start-up signal to a discharge lamp, the discharge lamp illumination circuit being used for illumination control using control means for controlling a power output from the DC-AC conversion circuit, wherein the DC-AC conversion circuit comprises:

an AC conversion transformer;

a plurality of switching elements; and a resonance capacitor, wherein the switching elements are activated by the control means, thereby causing serial resonance between the resonance capacitor and an inductance component of the AC conversion transformer, or between the resonance capacitor and an inductance component connected to the resonance capacitor;

wherein the operating frequency of the switching elements is controlled so that a resonance voltage generated at a primary side of the AC conversion transformer is boosted to supply electric power to the discharge lamp from a secondary side of the AC conversion transformer; and wherein when a resonance frequency of the discharge lamp during an extinction period is denoted as fi and a resonance frequency of the discharge lamp during an illumination period is denoted as f2, switching of a no-load voltage applied on the discharge lamp before the discharge lamp is illuminated is controlled in so that the operating frequency is regulated at a frequency that initially differs from f1 and then gradually approaches f1.

2. The discharge lamp illumination circuit according to claim 1 wherein the switching elements are activated in connection with the no-load output voltage by the control means such that the operating frequency is reduced from a frequency higher than f1 so as to approach f1.

3. The discharge lamp illumination circuit according to claim 2 wherein immediately after power is applied to the illumination circuit or immediately after the discharge lamp is extinguished after once having been illuminated, the operating frequency is regulated at a frequency higher than f2, thereby operating the switching elements.

4. The discharge lamp illumination circuit according to claim 1 wherein the switching elements are activated in connection with the no-load output voltage by the control means in such a manner that the operating frequency is set to an initial value of zero or a value lower than f1 and is then caused to increase from zero or the value so as to approach f1.

5. The discharge lamp illumination circuit according to claim 1 wherein after a predetermined period has elapsed from the start of control of the no-load voltage, the switching elements are activated so that the operating frequency is temporarily transitioned to a frequency region higher than f2, regardless of whether or not the discharge lamp is illuminating.

6. The discharge lamp illumination circuit according to claim 5 wherein the operating frequency is regulated at a frequency higher than f2 during a first period when the no-load voltage is boosted to a predetermined voltage, and during a subsequent second period when the operating frequency is fixed at a fixed value.

7. The discharge lamp illumination circuit according to claim 5 wherein the operating frequency is regulated at a frequency higher than f2 starting from a time at which the no-load voltage is boosted to a predetermined voltage and through a subsequent period when the operating frequency is fixed at a fixed value.

* * * * *